US007559501B2

(12) United States Patent
Jian

(10) Patent No.: US 7,559,501 B2
(45) Date of Patent: Jul. 14, 2009

(54) HOSE OR CABLE REEL

(76) Inventor: Huang Jian, Room 302, Unit 2, No. 3, Electric Block, Dongcheng Street, Yongkang City, Zhejiang (CN)

( * ) Notice: Subject to any disclaimer, the term of this patent is extended or adjusted under 35 U.S.C. 154(b) by 37 days.

(21) Appl. No.: 11/800,309

(22) Filed: May 4, 2007

(65) Prior Publication Data

US 2007/0272787 A1 Nov. 29, 2007

(51) Int. Cl.
*B65H 75/30* (2006.01)

(52) U.S. Cl. ..... 242/389; 242/394; 242/395; 137/355.23

(58) Field of Classification Search ..... 242/389, 242/394, 395; 137/355.2, 355.23
See application file for complete search history.

(56) References Cited

U.S. PATENT DOCUMENTS 1,881,958 A * 10/1932 Peo ..... 403/74
2,573,868 A * 11/1951 Newell ..... 137/355.21
2,973,906 A * 3/1961 Flinchbaugh et al. ..... 239/197
6,877,687 B2 * 4/2005 Moon et al. ..... 242/390.8
7,316,368 B2 * 1/2008 Moon et al. ..... 242/390.9

FOREIGN PATENT DOCUMENTS

CN 2573459 9/2003
EP 0 493 736 A2 7/1992

* cited by examiner

*Primary Examiner*—Sang Kim
(74) *Attorney, Agent, or Firm*—Eckert Seamans Cherin & Mellott, LLC; David C. Jenkins, Esq.

(57) ABSTRACT

This invention discloses a hose or cable reeler that can retract a hose or cable without the need for a retracting coil spring. The reeler generally comprises a reeling wheel assembly and a reeling wheel drive. The reeling wheel assembly is detachably coupled with the reeling wheel drive by means of a clutch. The reeling wheel drive mainly comprises a gear transmission chain, and is operated through a lever by manpower (e.g., treading of a foot). Since manpower is used to retract the hose or cable, this invention avoids the related problems that may occur when the retraction is achieved completely relying on the coil spring. For example, the disordered brandish, which may occur owing to an excessive retractive force, can be avoided during the retraction of the hose or cable, and a combined drive of manpower and retractive force of the coil spring is possible. Therefore, the hose (cable) reeler of this disclosure allows for an operation of the hose or cable in a relatively laborsaving, convenient and safe manner.

24 Claims, 22 Drawing Sheets

HOSE OR CABLE REEL

CROSS SECTION TO RELATED APPLICATION

This application claims priority under 35 U.S.C. §119 to Chinese Patent Application Ser. No. 2006.2011.2698.7, filed May 9, 2006, entitled, HOSE/CABLE REELER.

TECHNICAL FIELD

This invention relates to a hose (or cable) reeler used to store up hoses, cables or the like, and particularly to a treadle hose/cable reeler that achieves the retraction of hoses or cables using manpower, such as treading of a foot.

BACKGROUND ART

In the prior art hose/cable reelers used to store up hoses, cables or the like, the retraction of hoses or the like is achieved purely relying on a coil spring mounted inside the reeler. With the prior equipment, there are some problems as follows: the cost of the equipment is increased due to the need for a retracting coil spring; since the retraction is achieved by the coil spring, the retraction speed of the hose may be too fast and therefore during the retraction of the hose a brandish of the hose may occur, which may cause harms to people or damages to the hoses or cables; and once the coil spring fails, its maintenance or replacement is time-consuming and laborious.

SUMMARY OF THE INVENTION

It is an objective of this invention is to solve the above problems in the prior art. This invention aims to provide a hose/cable reeler which achieves the hose retraction without the need for a retracting coil spring, and therefore avoids the problems associated with the use of the retracting coil spring. In this invention, a coil spring is provided only as an auxiliary unit and has two functions: one is to increase the retractive force during the retraction of hoses or cables, and the other is to keep the continuity of the hoses or cables during extension or retraction and to solve the problems associated with the retraction purely relying on manpower.

In order to achieve the above objective, this invention provides a hose/cable reeler, comprising: a housing; a reeling wheel assembly, mounted in the housing, and including a reeling wheel axle supported by the housing and a reeling wheel mounted on the reeling wheel axle with the reeling wheel axle serving as a center, the reeling wheel being adapted to wind a hose, cable or the like thereon, and to rotate in a first direction to wind the hose and in a second direction opposite to the first direction to unwind the hose; and a reeling wheel drive mounted in the housing and detachably coupled with the reeling wheel through a clutch to drive the reeling wheel to rotate in the first direction, the reeling wheel being coupled with the reeling wheel drive when the clutch is operated into an engaged state, and the reeling wheel being uncoupled from the reeling wheel drive when the clutch is operated into a disengaged state.

The reeling wheel drive of the invention comprises: a lever, swingably supported by the housing, and having a stationary portion that is pivoted to the housing and a free end that is opposite to the stationary portion, the lever being adapted to swing manually within a predetermined range between a start position and an end position with the stationary portion as a fulcrum, and the lever being connected with a spring and biased by the spring towards the start position; a driven gear mounted coaxially and fixedly with respect to the reeling wheel; a driving gear mounted to engage the driven gear; a transmission gear mounted coaxially with respect to the driving gear; and a transmission member engaged with the transmission gear to drive the transmission gear, the transmission member having mesh teeth on a side facing the transmission gear to mesh with the driving gear, and the transmission member being connected with the lever to reciprocate as the lever swings.

In the above hose/cable reeler, the clutch may be an overrunning clutch, comprising a first clutch half and a second clutch half that are able to axially engage with and disengage from each other and a control mechanism that cooperates with the first clutch half to control the axial engagement and disengagement between the first clutch half and the second clutch half, the control mechanism including: a control member that is able to rotate on the reeling wheel axle and has a first cam portion; a first cam follower portion provided on the first clutch half and cooperated with the first cam portion of the control member; a second cam portion provided on the reeling wheel axle; a second cam follower portion provided on the first clutch half and cooperated with the second cam portion provided on the reeling wheel axle; a compression spring provided between the first clutch half and the second clutch half for biasing the halves in a direction of disengagement thereof, and a rotation damping means to damp down the rotation of the control member, wherein the control member is disposed to be axially stationary relative to the reeling wheel axle, the first clutch half is disposed relative to the reeling wheel axle so as to be movable axially within a determined lengthwise range and be rotatable within a determined angular range, the second clutch half is fixed to the reeling wheel, the first cam portion of the control member and the first cam follower portion of the first clutch half are configured such that when the first clutch half rotates, along with the second clutch half and the reeling wheel, in the second direction relative to the control member or when the reeling wheel rotates in the first direction relative to the reeling wheel axle, the first clutch half moves axially in a direction away from the second clutch half under the bias of the compression spring, whereby the clutch is operated into the disengaged state, and the second cam portion of the reeling wheel axle and the second cam follower portion of the first clutch half are configured such that when the reeling wheel axle rotates in the first direction relative to the first clutch half and the reeling wheel within the determined angular, the first clutch half moves axially towards the second clutch half against the bias of the compression spring, whereby the clutch is operated into the engaged state. The first cam portion may comprise at least one recess having a slope fixedly disposed on the control member and the first cam follower portion comprises at least one cog fixedly disposed on the first clutch half, the cog fitting in the recess and being able to slide along the slope of the recess. The cog may have a slope that is complementary to and mates with the slope of the recess. The second cam portion may comprise at least one key fixedly disposed on a circumferential surface of the reeling wheel axle and the second cam follower portion comprises at least one shaped groove having a slope fixedly disposed on the first clutch half, the key fitting in the shaped groove and being able to slide along the slope of the shaped groove. The key may have a slope that is complementary to and mates with the slope of the shaped groove. Both the first clutch half and the second clutch half may be formed with teeth on opposing end surfaces thereof, the first clutch half and the second clutch half being engaged with each other by means of the teeth. Both the first clutch half and the second clutch half may be formed with a counterbore on opposing end surfaces thereof, the compression spring being disposed between the first clutch half and the second clutch half with its opposite ends seated in the two counterbores respectively. The control member may be formed as a wave wheel with waved teeth on its circumference, the wave wheel being rotatably mounted on the reeling wheel axle, the waved teeth of the wave wheel being engaged with a detent that is mounted to the housing by means of a spring, and the detent engaging the waved teeth of the wave wheel under the bias of the spring, whereby the waved teeth, the detent and the spring constitute the rotation damping means for damping down the rotation of the wave wheel on the reeling wheel axle. The control member may be formed as a belt pulley with a belt winding portion on its circumference, the belt pulley being rotatably mounted on the reeling wheel axle, and a belt being wound on the belt winding portion of the belt pulley with opposite ends of the belt fixed to a stationary portion of the housing under a determined tension, whereby the belt and the belt winding portion constitute the rotation damping means for damping down the rotation of the belt pulley on the reeling wheel axle. The rotation damping means may further comprise a tension spring connected between one end of the belt and the stationary portion of the housing.

In the above hose/cable reeler, the clutch may comprise a first clutch half and a second clutch half that are able to axially engage with and disengage from each other and a control mechanism that cooperates with the first clutch half to control the axial engagement and disengagement between the first clutch half and the second clutch half, both the first clutch half and second clutch half being formed with one-way teeth that are able to engage with each other in a one-way manner, the first clutch half being fixed to the driven gear, and the second clutch half being fixed to the reeling wheel, wherein the control mechanism comprises: an external thread formed on a portion of a circumferential surface of the reeling wheel axle; an internal thread formed in a central bore of the first clutch half and engaging the external thread, the first clutch half being movable axially relative to the reeling wheel axle within a predetermined range by means of a screwing action between the internal thread and the external thread; a compression spring disposed between the first clutch half and second clutch half for biasing the first clutch half and second clutch half in a direction to separate them from each other; and a rotation damping means adapted to damp down the rotation of the reeling wheel axle, wherein the internal thread and the external are configured such that when rotating in the first direction the first clutch half moves axially towards the second clutch half against the bias of the compression spring until it is engaged with the second clutch half. The rotation damping means may comprise a wave wheel that is fixed to the reeling wheel axle and has waved teeth on its circumference, and a detent that is mounted to the housing through a spring and engages the waved teeth of the wave wheel, the detent engaging the waved teeth of the wave wheel under the bias of the spring to damp down the rotation of the wave wheel. The rotation damping means may comprise a belt pulley that is fixed to the reeling wheel axle and has a belt winding portion on its circumference, and a belt that is wound on the belt winding portion of the belt pulley, with opposite ends of the belt being fixed to a stationary portion of the housing under a determined tension, for damping down the rotation of the belt pulley. The rotation damping means may further comprise a tension spring that is connected between one end of the belt and the stationary portion of the housing. Both the first clutch half and the second clutch half may be formed with a counterbore on opposing end surfaces thereof, the compression spring being disposed between the first clutch half and the second clutch half with its opposite ends seated in the two counterbores respectively. The mating internal thread and external thread may be multi start thread.

In the above hose/cable reeler, the reeling wheel axle may comprise a principal reeling wheel axle that is fixed to the housing and a semi reeling wheel axle that is coaxial with the principal reeling wheel axle and is rotatably supported by the housing, and the reeling wheel assembly further comprises a coil spring mounted between the principal reeling wheel axle and the reeling wheel, with one end of the coil spring fixed to the principal reeling wheel axle and other end fixed to the reeling wheel.

In the above hose/cable reeler, the clutch is a manually operated clutch. The manually operated clutch may comprise a first clutch half and a second clutch half that are able to be axially engaged with and disengaged from each other, and a manually operated mechanism that is connected with at least one of the two clutch halves to control the axial engagement and disengagement between the first clutch half and the second clutch half.

In the above hose/cable reeler, a treadle may be mounted on the free end of the lever for treading.

In the above hose/cable reeler, the transmission member in the reeling wheel drive may be a sector gear that is fixed to the lever and swings reciprocally about the stationary portion along with the lever. The sector gear may be an internal gear.

In the above hose/cable reeler, the transmission member in the reeling wheel drive may be a gear rack, one end of which is connected to the lever so as to reciprocate linearly as the lever swings.

Since manpower (e.g., treading of a foot) is used as a moving force to retract a hose or cable, this invention avoids the related problems which may occur when the retraction is achieved completely relying on a retracting coil spring. For example, the brandish, which may occur owing to an excessive retractive force, can be avoided during the retraction of the hose or cable, and a combined drive of manpower and the retractive force of a coil spring is possible. Therefore, the hose/cable reeler of this invention allows for an operation of the hose or cable in a relatively labour-saving, convenient and safe manner.

DETAILED DESCRIPTION OF PREFERRED EMBODIMENTS

Figure 1:
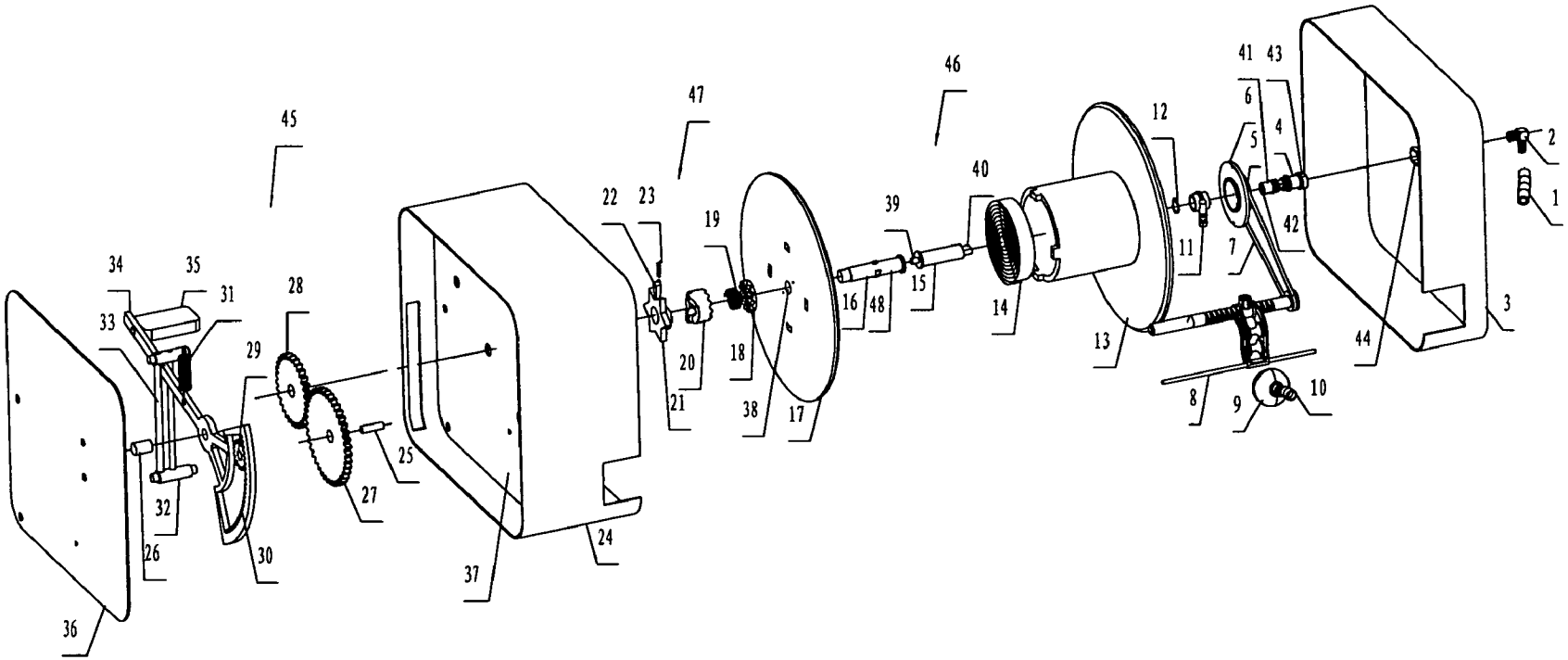
FIG. 1 is an exploded view of a treadle hose reeler according to a first embodiment of the invention.
Figure 2:
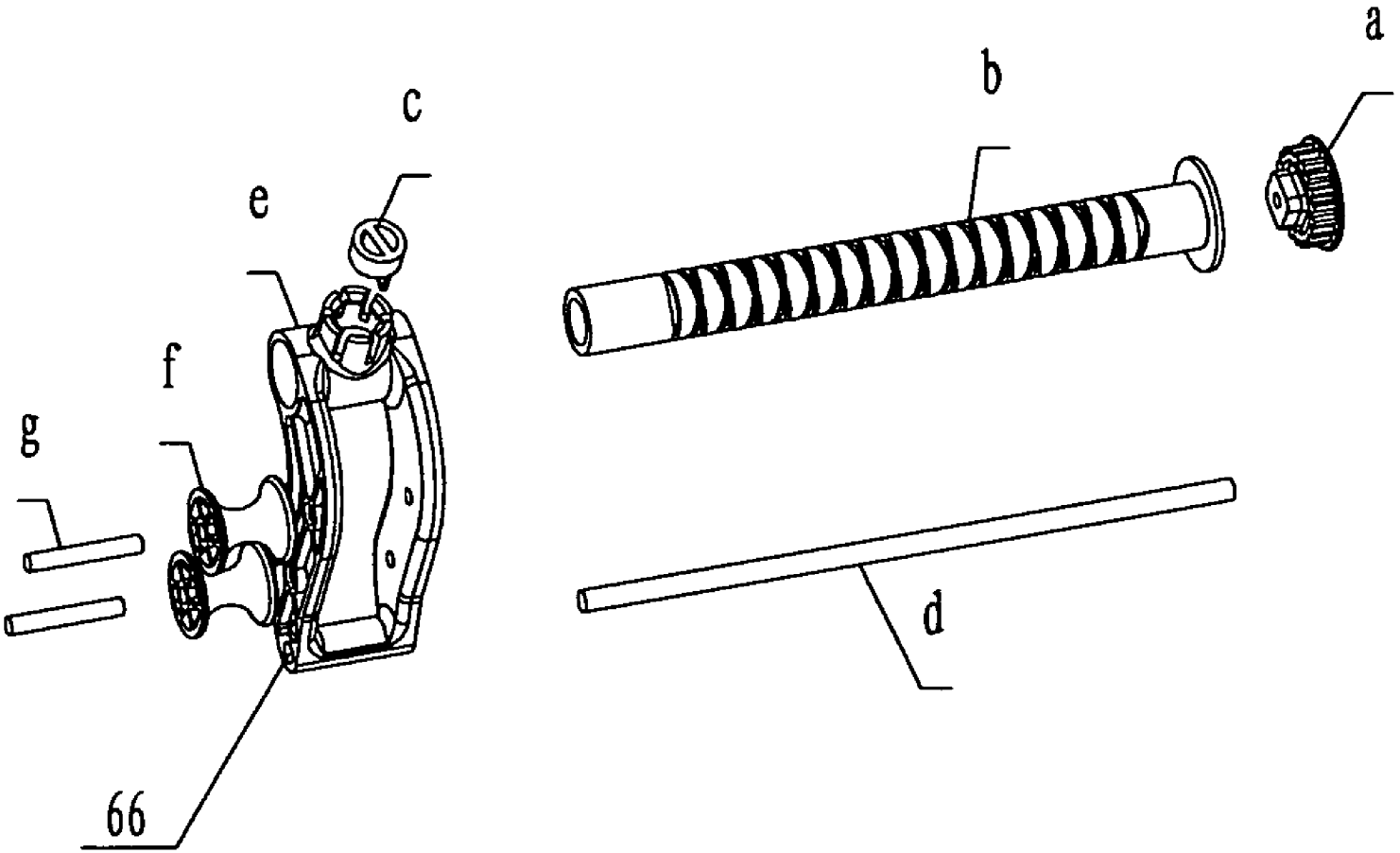
FIG. 2 is an exploded view of a hose distribution mechanism shown in FIG. 1.
Figure 3:
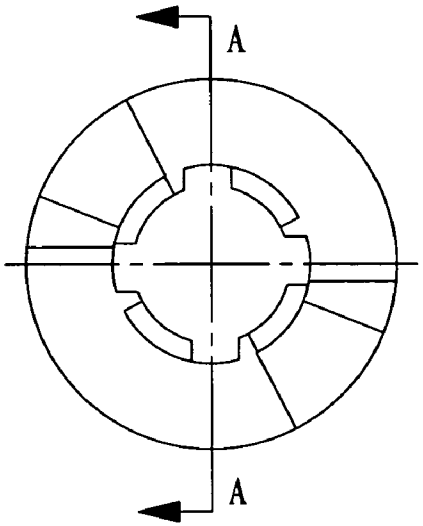
FIG. 3 is a front view of a first clutch half of an overrunning clutch used in the invention.
Figure 4:
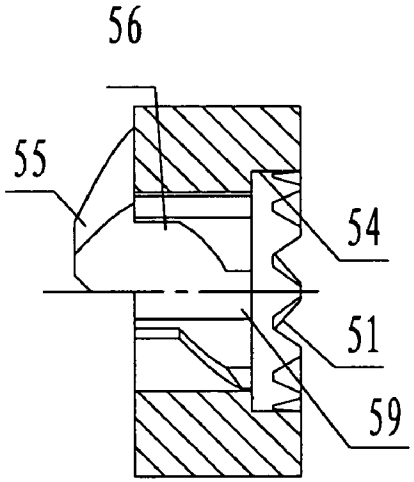
FIG. 4 is a sectional view along the A-A line in FIG. 3.
Figure 5:
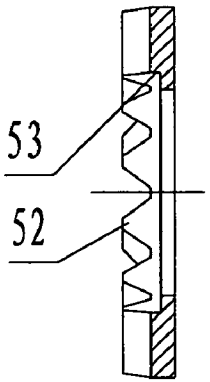
FIG. 5 is a sectional view of a second clutch half of the overrunning clutch.
Figure 6:
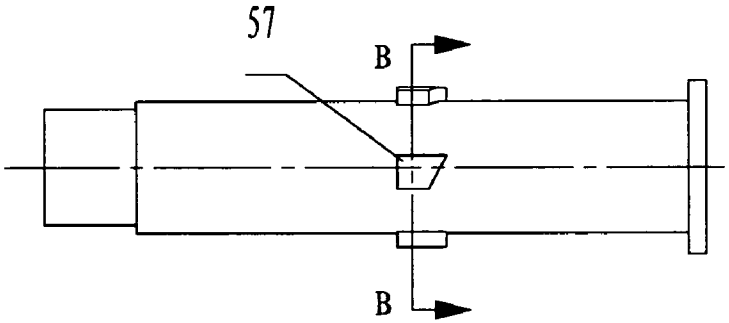
FIG. 6 is a front view of a semi reeling wheel axle.
Figure 7:
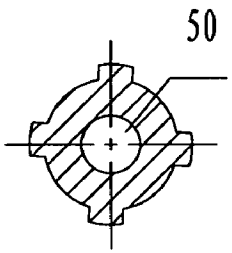
FIG. 7 is a sectional view along the B-B line in FIG. 6.

Several preferred embodiment of the invention will be described with reference to the accompanying drawings. For the purpose of simplicity and clarity, only the mechanisms and components which are related to the invention will be described in the embodiments in detail, and other mechanisms in the hose reeler such as hose distribution mechanism, water (air) inlet and outlet mechanism and the like which are not related to the invention will be described schematically and briefly.

First Embodiment

See FIGS. 1-13, which show a hose reeler according to the first embodiment of the invention. The hose reeler is a treadle hose reeler and is use to store up a hose 10. In order to prevent the hose 10 from being completely wound into the housing, a stopper 9 is fixed at the end of the hose 10. The hose reeler mainly comprises a housing, a reeling wheel assembly 46, a clutch 47, a reeling wheel drive 45, a hose distribution mechanism and a water (air) inlet and outlet mechanism. The housing is composed of a right housing 3 and a left housing 24. There is a side cover 36 on the left housing 24. A partition 37 is provided in the left housing 24 which substantially separates the left housing 24 into two, left and right, chambers. The left chamber is sealed by the side cover 36 and is used to hold a reeling wheel drive 45. The right chamber is sealed by the right housing 3 and is used to hold a reeling wheel assembly 46 and a clutch 47.

The reeling wheel assembly 46 comprises a principal reeling wheel axle 15 fixed to the left housing 24 and the right housing 3, a semi reeling wheel axle 16 rotatably mounted on the principal reeling wheel axle 15, a coil spring 14, and a reeling wheel that is mounted on and can rotate about the principal reeling wheel axle 15. The reeling wheel consists of a left reeling wheel disk 17 and a right reeling wheel disk 13 which are connected together. A central through hole 38 in the left reeling wheel disk 17 is fit with a circumferential surface 48 of the semi reeling wheel axle 16. A left end of the right reeling wheel disk 13 is fixed to the left reeling wheel disk 17, and a right end thereof is rotatably supported on a circumferential surface 41 of a stationary axle 4 which is fixed to the right housing 3. A shaped key 40 on the right end of the principal reeling wheel axle 15 cooperates with a shaped hole 42 in the stationary axle 4 which is fixed to the right housing 3. In this way, the principal reeling wheel axle 15 is fixed to the right housing 3 through the stationary axle 4. The left end of the principal reeling wheel axle 15 is movably connected with the semi reeling wheel axle 16 through an axial part 39 provided on the axle 15 and a hole 50 in the axle 16. On the right end of the principal reeling wheel axle 15 there is a slit 49. One end of the coil spring 14 is fixed to the right reeling wheel disk 13 and the other end is fixed to the principal reeling wheel axle 15 through the slit 49.

The clutch 47 is an overrunning clutch which consists of a first clutch half 20 and a second clutch half 18 with teeth on their one end face respectively and a control mechanism which is fit with the first clutch half 20 (the left one in FIG. 1). The teeth 51 on the right end face of the first clutch half 20 can be engaged with and disengaged from the teeth 52 on the left end face of the second clutch half 18, therefore an axial engagement and disengagement between the two clutch halves can be obtained. The control mechanism consists of a control member 21, a detent 22, a spring 23 and the semi reeling wheel axle 16. The second clutch half 18 is fixed to the left reeling wheel disk 17. On the left side of the second clutch half 18 there is a counterbore 53. On the right side of the first clutch half 20 there is a counterbore 54 and on the left side of the first clutch half 20 there are one-way cogs 55. Along the axial direction of the first clutch half 20 there are four shaped grooves 56 each with a shape of 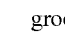 .

A compression spring 19 is fit around a circumferential surface of the semi reeling wheel axle 16, with its one end seated in the counterbore 53 of the second clutch half 18 and the other end seated in the counterbore 54 of the first clutch half 20. There are four shaped keys 57 having a shape of 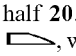 , which fit with the respective shaped grooves 56 on the first clutch half 20. The control member 21 is formed as a wave wheel with waved teeth around its circumference. On the right side there are recesses 58 which can be engaged with the one-way cogs 55 on the first clutch half 20. The control member 21 is rotatably situated around a cylindrical portion of the semi reeling wheel axle 16, with no axial movement allowed relative to the semi reeling wheel axle 16. The detent 22 is fixed to a stationary portion of the left housing 24. One end of the spring 23 is fixed to a stationary portion of the left housing 24 and the other end thereof is connected to the detent 22. The detent 22 is used to damp down the rotation of the control member 21 in any direction.

The hose distribution mechanism is mounted on the housing and consists of a synchronizing gear 6, a synchronizing gear cover 5, a guide column d, a pinion gear a, a two-way trapezoid screw b, a commutator c, a mounting frame e, two small pulleys f, two iron bars g, and a timing toothed belt 7. The synchronizing gear 6 is coaxially fixed to the right side of the right reeling wheel disk 13. The synchronizing gear cover 5 is connected to the synchronizing gear 6 which is connected to the hose distribution mechanism through the timing toothed belt 7. The pinion gear a is situated on one side of the two-way trapezoid screw b to correspond to the synchronizing gear 6. The mounting frame e is situated on the two-way trapezoid screw b. The commutator c is situated on the mounting frame e. The guide column d is situated on the left housing 24 and the right housing 3. A round hole 66 in the mounting frame e is fit with the guide column d. The small pulleys are movably connected to the mounting frame e through the two iron bars g. The function of the hose distribution mechanism is to distribute the hose (or cable) in order during winding. When a hose or cable is being wound up, the right reeling wheel disk 13 drives the synchronizing gear 6 to rotate, and the synchronizing gear 6 in turn drives the pinion gear a through the timing toothed belt 7, therefore the two-way trapezoid screw b is rotated. In this way, the distribution of the hose can be achieved. Once a layer of the hose is full up, the mounting frame will automatically switch over to the next layer by means of the commutator c.

The water (air) inlet and outlet mechanism mainly consists of a water (air) tie-in 2, a stationary axle 4 and a water (air) inlet connector 11. One end of the stationary axle 4 is fixed to the principal reeling wheel axle 15, and the other end 43 thereof is specially shaped and is fit to a shaped hole 44 in the right housing 3 to fix the stationary axle 4. There is an axial water (air) inlet in the stationary axle 4 with the tie-in 2 fixed to it. The water (air) inlet connector 11 is fit around the stationary axle 4. On a side of the water (air) inlet connector 11 there is a water (air) outlet. The water (air) outlet of the stationary axle 4 corresponds to the water (air) outlet of the water (air) inlet connector 11. A water (air) outlet hose 10 wound on the reeling wheel is connected to side water (air) outlet of the water (air) inlet connector 11. At the joint between the stationary axle 4 and the water (air) inlet connector 11 there is a ring groove in which a sealing ring is fit. On one side of the ring groove of the stationary axle 4 there is a spring washer 12 which allows the stationary axle 4 and the water (air) inlet connector 11 to rotate freely with no leakage of water (air). A water (air) inlet pipe 1 is fixed to the water (air) tie-in 2.

In this embodiment, the reeling wheel drive 45 consists of a tension spring 31, a transmission gear 29, an internal sector gear 30, a driving gear 27, a driven gear 28, secondary axles 25 and 26, a lever 34, a treadle 35 and an optional bracket. The bracket consists of two horizontal columns 32 and two vertical cylindrical columns 33, and is used to limit the movement of the lever 34. The two columns 32 are fixed to a stationary portion of the left housing 24. The two ends of the two cylindrical columns 33 are connected to the two columns 32. The bracket is helpful to define the movement range of lever 34 in a firmer manner. However, in many cases, the bracket is not necessary and can be replaced by equivalent means. The lever 34 is pivotally mounted to the side cover 36 through the secondary axle 26 and can pivot about an axis of the secondary axle 26. On a free end of the lever 34 there is a treadle 35 which can be trod by a user's foot to apply a force to the lever. An internal sector gear 30 is fixed to a side of the lever 34 opposite to the treadle 35. The internal sector gear 30 is used as a transmission member which can engage the transmission gear 29 and therefore drive it. The internal sector gear 30 is fixed to the lever 34 in such a way that it can rotate about the secondary axle 26 as the lever 34 swings. The transmission gear 29 is engaged internally with the internal sector gear 30. The transmission gear 29 and the driving gear 27 are coaxially fixed to the secondary axle 25 which is fixed to a stationary portion of the left housing 24. The secondary axle 25 can rotate about its axis. The driving gear 27 engages the driven gear 28 externally. The driven gear 28 is coaxially fixed to the semi reeling wheel axle 16. One end of the tension spring 31 is fixed to a stationary portion of the housing, and the other end thereof is fixed to the lever proximate to the treadle.

When the hose is pulled out, the lever 34 is at the start position with the clutch 47 in the disengaged state. At this time, both the principal reeling wheel axle 15 and the semi reeling wheel axle 16 remain stationary, and the reeling wheel rotates counterclockwise about the principal reeling wheel axle 15. During the rotation of the reeling wheel, the coil spring 14 is tensioned, and the energy is accumulated.

When the treadle 35 is being pressed down, the lever 34 drives the internal sector gear 30 to rotate counterclockwise. Under the action of the internal sector gear 30, the transmission gear 29 rotates counterclockwise. Since the driving gear 27 and the transmission gear 29 are fixed coaxially, the driving gear 27 rotates counterclockwise under the driving of the transmission gear 29. Acted by the driving gear 27, the driven gear 28 rotates clockwise. Since the driven gear 28 is fixed to the semi reeling wheel axle 16, the semi reeling wheel axle 16 rotates clockwise under the action of the driven gear 28. The rotation of the semi reeling wheel axle 16 causes the first clutch half 20 to rotate clockwise. Since at this time the one-way cogs 55 of the first clutch half 20 are engaged with the recesses 58 of the control member 21 and the detent 22 damps down the rotation of the control member 21, the movement of the first clutch half 20 lags behind the movement of the semi reeling wheel axle 16. Under the camming actions between the slopes of the shaped keys 57 of the semi reeling wheel axle 16 and the slopes of the shaped grooves 56 of the first clutch half 20, the one-way cogs 55 of the first clutch half 20 slide out of the recesses 58 of the control member 21, and the first clutch half moves toward the second clutch half 18 against the action of the compression spring 19, resulting in the engagement of the teeth 51 of the first clutch half 20 with the teeth 52 of the second clutch half 18. Therefore, the first clutch half and the second clutch half are engaged with each other axially. Then the first clutch half 20 drives the second clutch half 18 to rotate clockwise, and in turn, drives the reeling wheel to rotate clockwise. Thus, the retraction of the hose is achieved. At this time, the tension spring 31 is in tension.

During the retraction of the hose, energy is released from the coil spring 14. The coil spring 14 has two functions, one is to increase the retractive force and the other is to keep the continuity of the hose retraction. Of course, the elasticity of the coil spring 14 is lower than that of the coil spring used in a conventional hose reeler in which the hose retraction purely relies on the retracting coil spring. Once the clockwise rotation speed of the reeling wheel is higher than that of the semi reeling wheel axle 16 under the action of the coil spring 14 and the inertia, there will be a relative rotation between the reeling wheel and the semi reeling wheel axle 16. Meanwhile, the first clutch half 20 rotates clockwise with the reeling wheel. That means there is a relative rotation between the semi reeling wheel axle 16 and first clutch half 20. When the shaped key 57 of the semi reeling wheel axle 16 slides along the slope of the shaped groove 56 to the opening 59, i.e., the portion having no slope, of the shaped groove 56 following the rotation of the semi reeling wheel axle 16, the first clutch half 20 moves axially away from the second clutch half 18 under the action of the compression spring 19 and therefore the clutch is in the disengaged state. In this way, the reeling wheel is allowed to rotate in a speed higher than that of the semi reeling wheel axle 16.

When the treadle 35 is released, the lever 34 drives the internal sector gear 30 to rotate clockwise under the action of the tension spring 31, and the transmission gear 29 rotates clockwise under the action of the internal sector gear. Since the driving gear 27 is coaxially fixed to the transmission gear 29, the driving gear 27 rotates clockwise under the driving of the transmission gear 29, and the driven gear 28 rotates counterclockwise under the action of the driving gear 27. Since the driven gear 28 is fixed to the semi reeling wheel axle 16, under the action of the driven gear 28, the semi reeling wheel axle 16 rotates counterclockwise. During the counterclockwise rotation of the semi reeling wheel axle 16, due to the axial bias of the compression spring 19 to the first clutch half 20 and the camming action of the recesses 58 of the control member 21 on the one-way cogs 55 of the first clutch half 20, the first clutch half 20 moves axially away from the second clutch half 18 until the one-way cogs 56 of the first clutch half 20 entirely fall into the recesses 58 of the control member 21, and therefore the clutch 47 is in the disengaged state.

Second Embodiment

See FIG. 14-21 which show a hose reeler according to the second embodiment of the invention. In order to be simple, the mechanisms such as the hose distribution mechanism and the water (air) inlet and outlet mechanism which are the same as in the first embodiment will not be described.

In this embodiment, except the clutch 47B and the semi reeling wheel axle 16B, the structures are basically the same as in the first embodiment. In this embodiment, the semi reeling wheel axle 16B is a substantially smooth axle, and its circumferential surface 48 is movably fit to a central through hole 38 of the left disk 17. The left end of the principal reeling wheel axle 15 is movably coupled to the semi reeling wheel axle 16B through an axial part 39 provided on the left end of the axle 15 and a hole 50 in the axle 16. There is a length of external thread 65 proximate the middle portion of the semi reeling wheel axle 16B.

The reeling wheel drive 45 consists of a tension spring 31, a transmission gear 29, an internal sector gear 30, a driving gear 27, a driven gear 28, secondary axles 25 and 26, a lever 34, a treadle 35 and an optional bracket. The lever 34 is pivotally mounted to the side cover 36 through the secondary axle 26 and can pivot about an axis of the secondary axle 26. On a free end of the lever 34 there is a treadle 35 which can be trod by a user's foot to apply a force to the lever. An internal sector gear 30 is fixed to a side of the lever 34 opposite to the treadle 35. The internal sector gear 30 is used as a transmission member which can engage the transmission gear 29 and therefore drive it. The internal sector gear 30 is fixed to the lever 34 in such a way that it can rotate about the secondary axle 26 as the lever 34 swings. The transmission gear 29 is engaged internally with the internal sector gear 30. The transmission gear 29 and the driving gear 27 are coaxially fixed to the secondary axle 25 which is fixed to a stationary portion of the left housing 24. The secondary axle 25 can rotate about its axis. The driving gear 27 engages the driven gear 28 externally. One end of the tension spring 31 is fixed to a stationary portion of the housing, and the other end thereof is fixed to the lever 34 proximate to the treadle.

In this embodiment, the clutch 47B consists of a driven gear 28B, a transmission connector 18B, a semi reeling wheel axle 16B, and a rotation damping means that damps down the rotation of the semi reeling wheel axle. On a side of the driven gear 28B facing the reeling wheel there are one-way teeth 63 that are distributed regularly, which corresponds to a first clutch half. There is a counterbore 62 in the driven gear 28B axially, and in an axial hole of the driven gear there is provided an internal thread 64. The transmission connector 18B is coaxially fixed to the reeling wheel. On a side of the transmission connector 18B facing the driven gear 28B there are one-way teeth 61 that can mesh with the one-way teeth in a one-way manner, which corresponds to a second clutch half. There is an axial counterbore 60 on the transmission connector 18B, an axial hole 66 of which is movably fit with a circumferential surface 48 of the semi reeling wheel axle 16B. The structure of the one-way teeth 61 and 63 which mesh with each other in the one-way manner is well known in art, for example, including the incline teeth arranged circumferentially. The driven gear 28B and the semi reeling wheel axle 16B are cooperatively coupled with each other through the internal thread 64 and the external thread 65, and the driven gear 28B is allowed to move axially on the semi reeling wheel axle 16B within a predetermined range via the screwing action of these threads. Preferably, the internal and external threads 64, 65 are multi start threads. A compression spring 19B is fit around the circumferential surface of the semi reeling wheel axle 16B, with one end seated in the counterbore 62 of the driven gear 28B and the other seated in the counterbore 60 of the transmission connector 18B. The compression spring 19B is used to bias the driven gear 28B in a direction away from the transmission connector 18B. The rotation damp mechanism consists of a wave wheel 21B that is fixed to the semi reeling wheel axle 16B and has waved teeth on its circumference, and a detent 22 that is engaged with the waved teeth of the wave wheel 21B and is fixed to the left housing 24 through a spring 23. One end of the spring 23 is fixed to a stationary portion of the left housing 24 and the other end thereof is connected to the detent 22. The detent 22 is used to damp down the rotation in any direction of the wave wheel 21B, and in turn, the semi reeling wheel axle 16B.

When the hose is pulled out, the lever 34 is in the start position and the one-way teeth 63 on the driven gear 28B and the one-way teeth 61 on the transmission connector 18B are in the disengaged state. At this time, both the principal reeling wheel axle 15 and the semi reeling wheel axle 16B remain stationary, and the reeling wheel rotates counterclockwise about the principal reeling wheel axle 15. During the movement of the reeling wheel, the coil spring 14 is tensioned, which means the energy is accumulated.

When the treadle 35 is being pressed down, the lever 34 drives the internal sector gear 30 to rotate counterclockwise, and the transmission gear 29 rotates counterclockwise under the action of the internal sector gear 30. Since the driving gear 27 and the transmission gear 29 are fixed coaxially, the driving gear 27 rotates counterclockwise under the driving of the transmission gear 29. Acted by the driving gear 27, the driven gear 28B rotates clockwise. Since the driven gear 28B is cooperatively coupled with the semi reeling wheel axle 16B by means of threads, the clockwise rotation of the driven gear 28B causes the semi reeling wheel axle 16B to rotate clockwise therewith. However, due to the damping action of the detent 22 on the rotation of the rotation damper 21B, the rotation of the semi reeling wheel axle 16B lags behind the rotation of the driven gear 28B. In this case, the driven gear 28B moves on the semi reeling wheel axle 16B toward the transmission connector 18B via screwing action, until the one-way teeth 63 on the driven gear 28B mesh with the one-way teeth 61 on the transmission connector 18B, which operates the clutch 47B into the engaged state. Then, under the action of the driven gear 28B, the transmission connector 18B rotates clockwise, which drives the reeling wheel fixed thereto to rotate clockwise. Therefore the hose is retracted. At this time, the tension spring 31 is in tension.

During the retraction of the hose, energy is released from the coil spring 14. The coil spring 14 has two functions, one is to increase the retractive force and the other is to keep the continuity of the hose retraction. Of course, the elasticity of the coil spring 14 is lower than that of the coil spring used in a conventional hose reeler in which the hose retraction purely relies on the coil spring. Once the clockwise rotation speed of the reeling wheel is higher than that of the semi reeling wheel axle 16 under the action of the coil spring 14 and the inertia (i.e., there is a relative rotation between the transmission connector 18B and the driven gear 28B, and the movement of the driven gear 28B lags behind the movement of the transmission connector 18B), due to the damping action of the detent 22 on the wave wheel 21B, the semi reeling wheel axle 16B remains stationary relative to the driven gear 28B, and the one-way teeth 63 of the driven gear 28B escape from the one-way teeth 61 of the transmission connector 18B under the actions of the one-way teeth 61 of the transmission connector 18B and the compression spring 19B. Then, the transmission gear 28B moves away from the transmission connector 18B, until the one-way teeth 63 of the driven gear 28B is disengaged from the one-way teeth 61 of the transmission connector 18B. In this way, the reeling wheel is allowed to rotate in a speed higher than that of the semi reeling wheel axle 16B.

When the treadle 35 is released, under the action of the tension spring 31, the lever 34 drives the internal sector gear 30 to rotate clockwise, and under the action of the internal sector gear, the transmission gear 29 rotates clockwise. Since the driving gear 27 is coaxially fixed to the transmission gear 29, driven by the transmission gear 29, the driving gear 27 rotates clockwise, and the driven gear 28B rotates counterclockwise under the action of the driving gear 27. Due to the damping action of the detent 22 on the rotation damper 21B, the semi reeling wheel axle 16B remains stationary relative to the driven gear 28B. In this case, the driven gear 28B moves away from the transmission connector 18B via the action of screwing. Then the one-way teeth 63 of the driven gear 28B are disengaged from the one-way teeth 61 of the transmission connector 18B. Therefore, the driven gear 28B is in idle running about the axis of the semi reeling wheel axle 16B.

Third Embodiment

Figure 22:
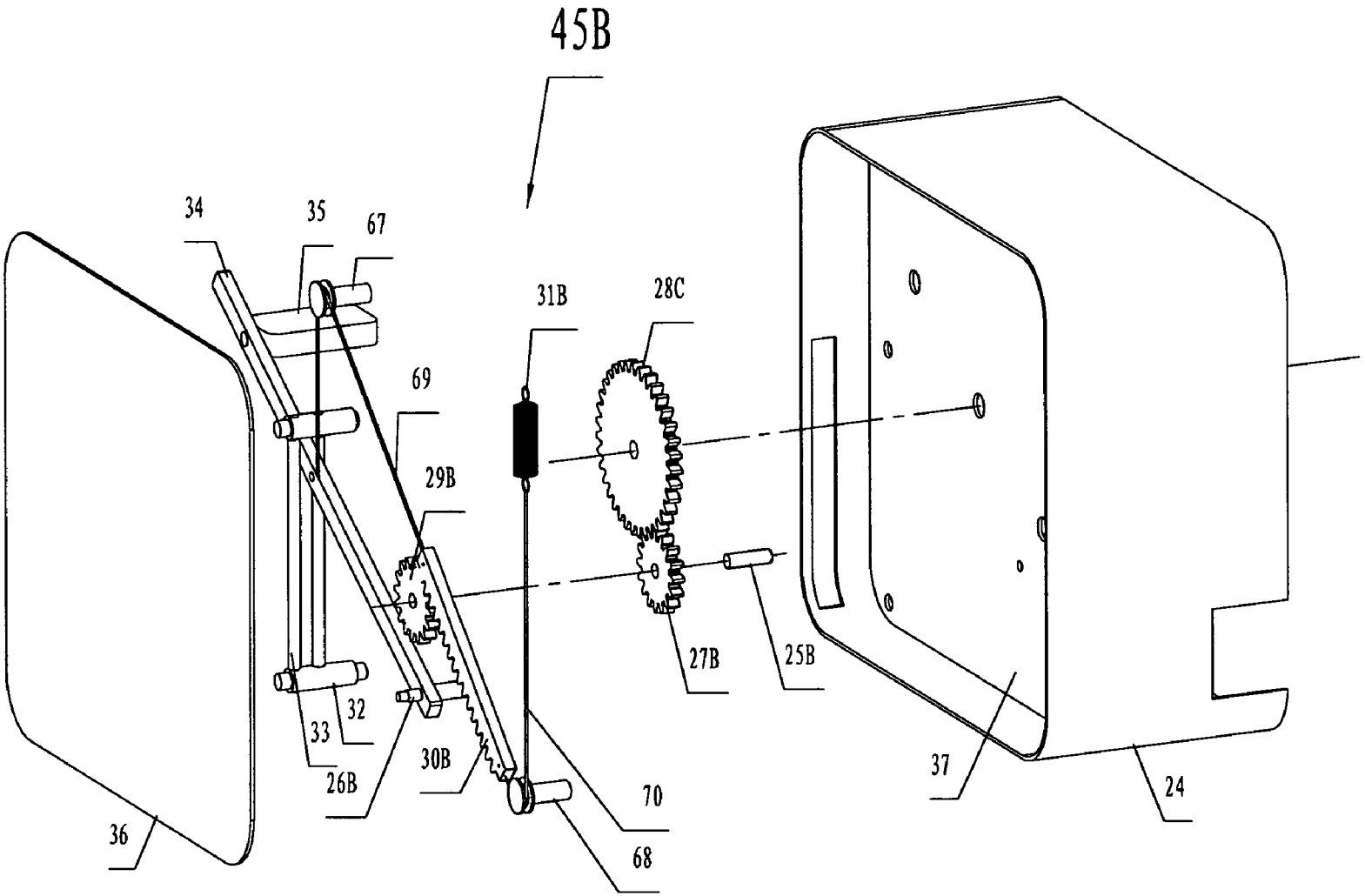
FIG. 22 is an exploded view of a reeling wheel drive in a hose reeler according to a third embodiment of the invention.
Figure 23:
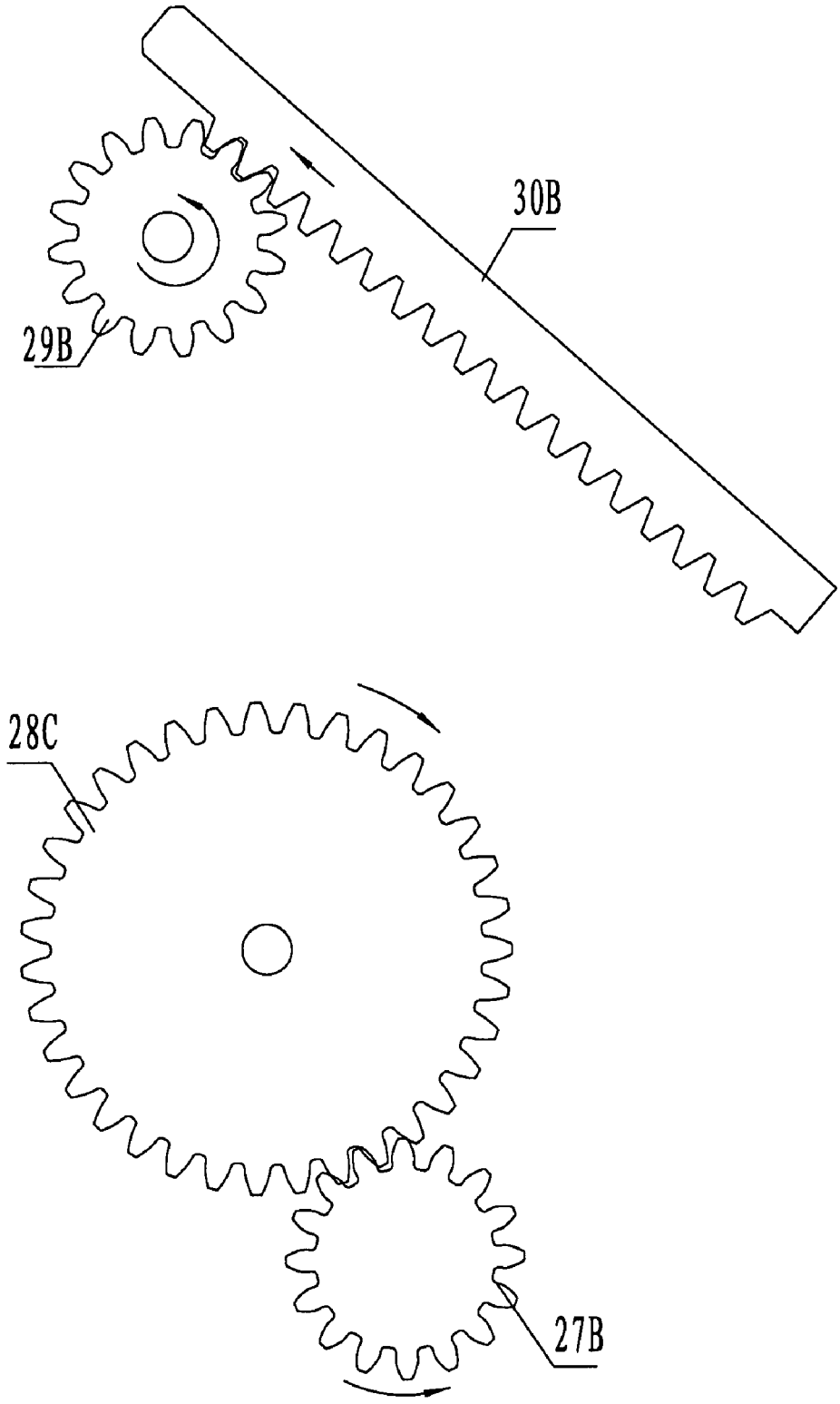
FIG. 23 is a schematic diagram showing the movements of various parts of the reeling wheel drive when a treadle is trod down in the third embodiment.
Figure 24:
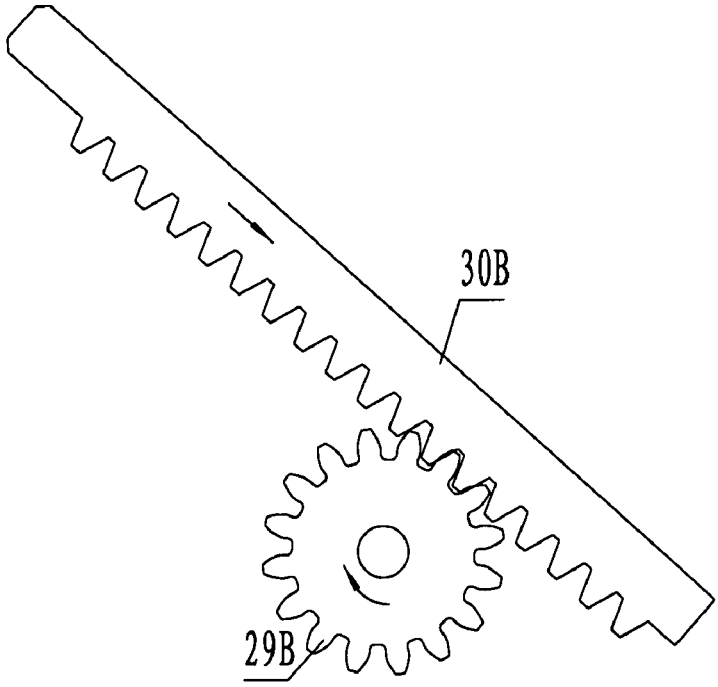
FIG. 24 is a schematic diagram showing the movements of the various parts of the reeling wheel drive when the treadle is released in the third embodiment.
Figure 24:
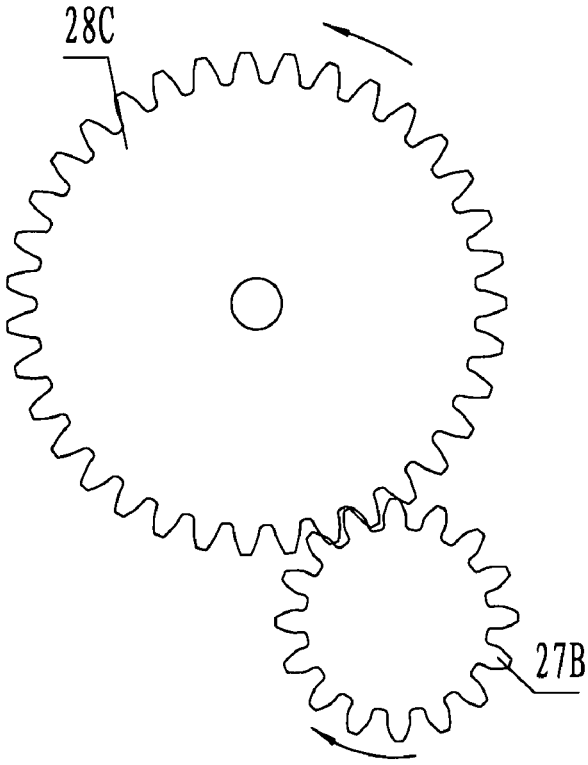

See FIGS. 22-24 which show a reeling wheel drive of a hose reeler according to the third embodiment of the invention. In the embodiment, except the reeling wheel drive, the components may be substantially the same as those in the first embodiment. Therefore, only the hose reeler drive is described and shown. As for the other parts, reference can be made to the first embodiment.

In this embodiment, the reeling wheel drive 45B consists of a transmission gear 29B, a gear rack 30B, a driving gear 28C, wire ropes 69 and 70, pulleys 67 and 68, a secondary axle 25B, a tension spring 31B, a lever 34, a treadle 35 and an optional bracket. The lever 34 has a stationary portion pivotally mounted to the housing and an opposite free end. On the free end of the lever 34 there is a treadle 35 which can be trod by a user's foot to apply a force to the lever. The stationary portion of the lever 34 is pivotally fixed to the left housing 24 through a pivot 26B. One end of the wire rope 69 is connected to an approximately middle portion of the lever 34 and the other is connected to the end of the gear rack 30B proximate to the treadle 35. One end of the wire rope 70 is connected to the end of the gear rack 30B away from the treadle 35 and the other end thereof is connected to the tension spring 31B, with the middle portion tensioned by the pulley 68, One end of the tension spring 31B is connected to the wire rope 70 and the other to a stationary portion of the left housing 24. The pulleys 67, 68 are fixed to a stationary portion of the left housing 24 respectively. The gear rack 29B is disposed such that when the treadle 35 is in the start position and end position the transmission gear 29B always meshes with the gear rack 30B. The transmission gear 29B and the driving gear 27B are coaxially fixed to the secondary axle 25B which is fixed to a stationary portion of the left housing 24. The secondary axle 25B is rotatable about its axis. The driving gear 27B is externally meshed with the driven gear 28C. The driven gear 28C and the semi reeling wheel axle 16 are coaxially fixed with each other.

When the hose is pulled out, the lever 34 is in the start position and the clutch 47 is in the disengaged state. At this time, both the principal reeling wheel axle 15 and the semi reeling wheel axle 16 remain stationary, and the reeling wheel rotates counterclockwise about the principal reeling wheel axle 15. During the rotation of the reeling wheel, the coil spring 14 is tensioned, which means energy is accumulated.

When the treadle 35 is being pressed down, the lever 34 drives the wire rope 69 to move in a direction in which the hose is retracted, and therefore the gear rack 30B is driven to move in the direction in which the hose is retracted. Under the action of the gear rack 30B, the transmission gear 29B rotates counterclockwise. Since the transmission gear 29B is coaxially fixed to the driving gear 27B, the transmission gear 29B drives the driving gear 27B to rotate counterclockwise, and under the action of the driving gear 27B, the driven gear 28C rotates clockwise. As the driven gear 28C is fixed to the semi reeling wheel axle 16, under the action of the driven gear 28C, the semi reeling wheel axle 16 rotates clockwise. At this time, the clutch is in the engaged state (the principle is the same as in the first embodiment), and the reeling wheel rotates clockwise, whereby the hose is retracted. At this time, the tension spring 31B is in tension.

During the retraction of the hose, energy is released from the coil spring 14. Once the clockwise rotation speed of the reeling wheel is higher than that of the semi reeling wheel axle 16 under the action of the coil spring 14 and the inertia, there will be a relative rotation between the reeling wheel and the semi reeling wheel axle. Since the first clutch half 20 rotates clockwise following the reeling wheel, that means there is a relative rotation between the semi reeling wheel axle 16 and the first clutch half 20. When the shaped key 57 on the semi reeling wheel axle 16 slides along the slope of the shaped groove 56 to the opening 59 of the shaped groove 56 as the semi reeling wheel axle 16 rotates, the first clutch half 20 moves axially away from the second clutch half 18 under the action of the compression spring 19, and therefore the clutch is in the disengaged state. In this way, the reeling wheel is allowed to rotate in a speed higher than that of the semi reeling wheel axle 16.

When the treadle 35 is released, under the action of the tension spring 31B, the wire rope 70 moves in the direction in which the hose is pulled out, and therefore, the gear rack 30B is driven. And under the action of the gear rack 30B, the transmission gear 29B rotates clockwise. Since the driving gear 27B is coaxially fixed to the transmission gear 29B, the driving gear 27B rotates clockwise under the driving of the transmission gear 29B, and the driven gear 28C rotates counterclockwise under the driving of the driving gear 27B. Since the driven gear 28C is fixed to the semi reeling wheel axle 16, under the action of the driven gear 28C, the semi reeling wheel axle 16 rotates counterclockwise. During the counterclockwise rotation of the semi reeling wheel axle 16, due to the axial bias of the compression spring 19 to the first clutch half 20 and the camming actions of the recesses 58 of the control member 21 on the one-way cogs 55 of the first clutch half 20, the first clutch half 20 moves axially away from the second clutch half 18 until the one-way cogs 55 of the first clutch half 20 entirely falls into the recesses 58 of the control member 21, whereby the clutch 47 is in the disengaged state.

Fourth Embodiment

Figure 25:
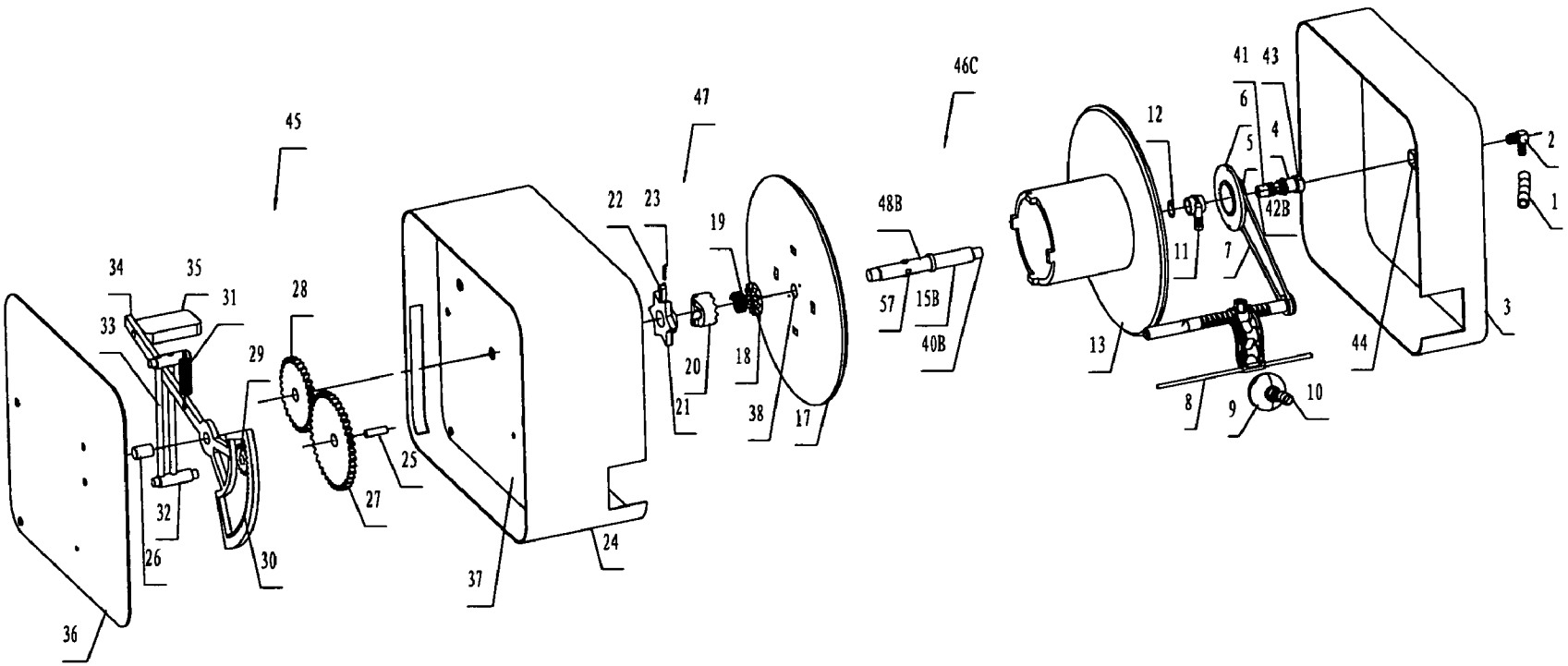
FIG. 25 is an exploded view of a treadle hose reeler according to a fourth embodiment of the invention.
Figure 26:
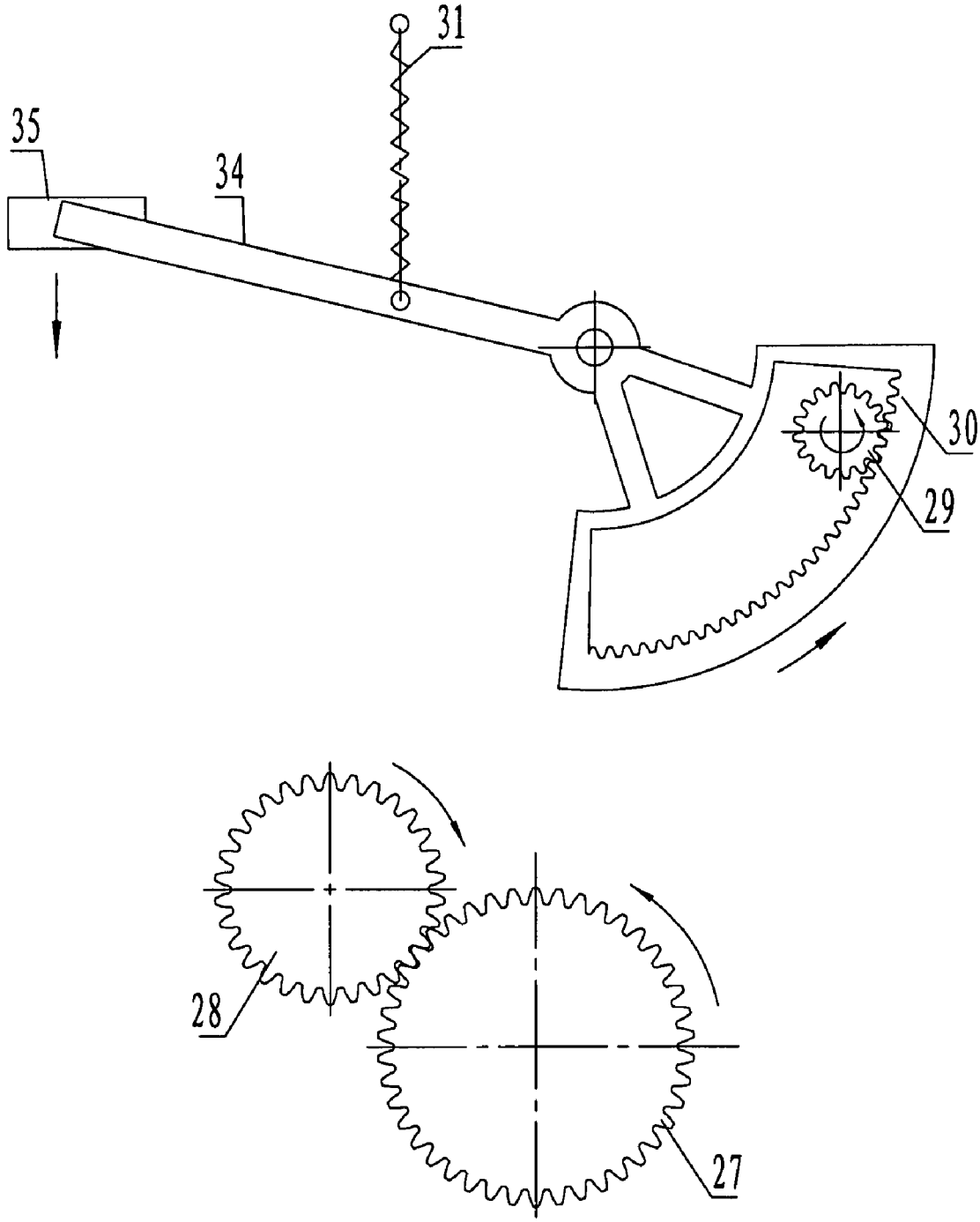
FIG. 26 is a schematic diagram showing the movement of various parts of a reeling wheel drive when a treadle is trod down in the fourth embodiment.
Figure 27:
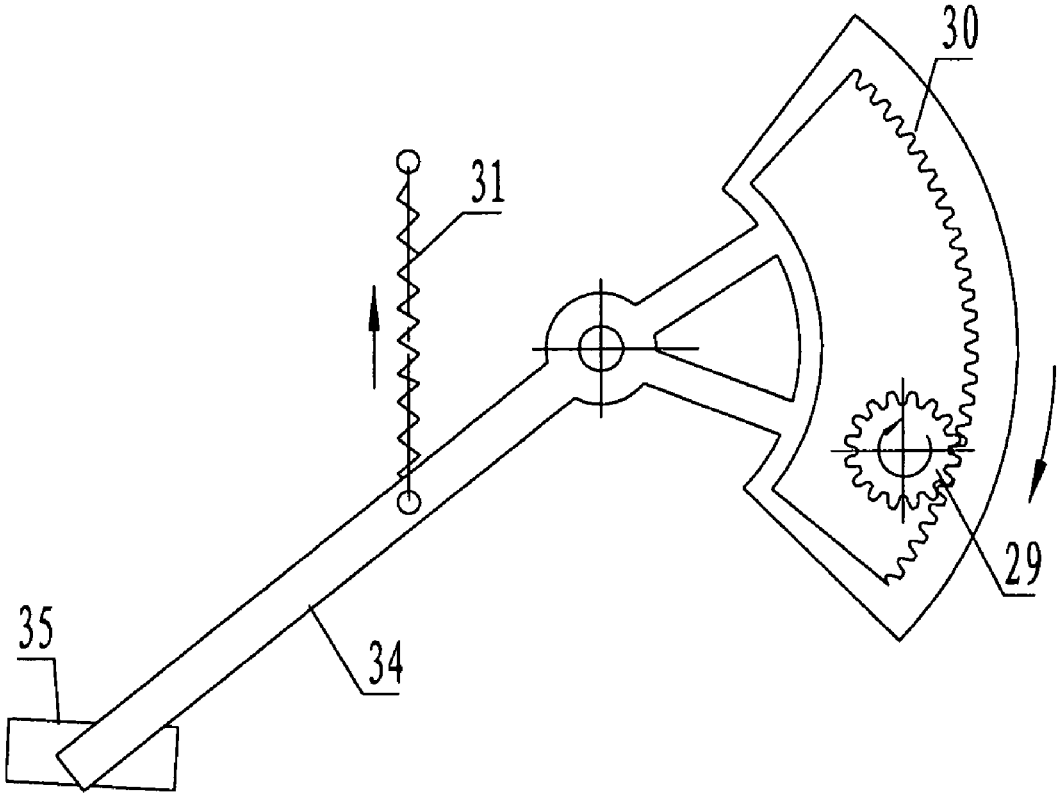
FIG. 27 is a schematic diagram showing the movement of the various parts of the reeling wheel drive when the treadle is released in the fourth embodiment.
Figure 27:
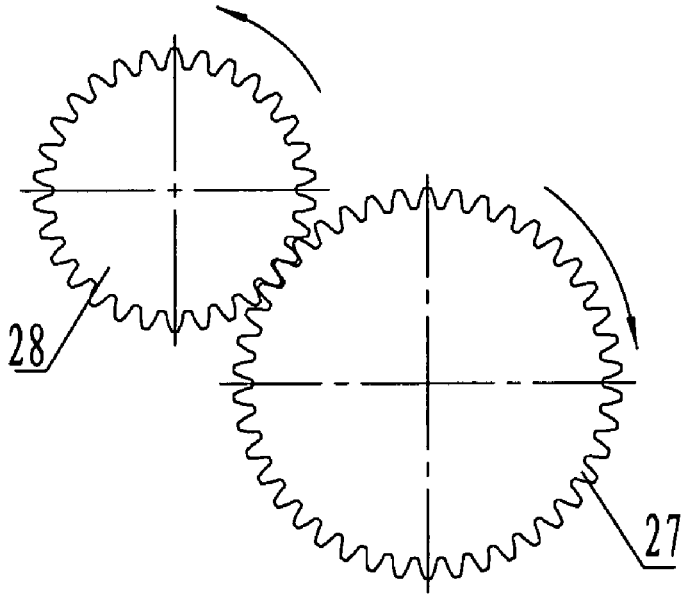

See FIGS. 25-27 which show a hose reeler according to the forth embodiment of the invention. This embodiment is substantially the same as the first embodiment of the invention with the difference lying in that a coil spring as in the first embodiment is not used and a single axle is employed here as a reeling wheel axle to replace the combination of the principal reeling wheel axle and the semi reeling wheel axle in the first embodiment. Therefore, only the portion different from the first embodiment will be described, and the remainders can refer to the first embodiment.

In this embodiment, since no coil spring is used in the reeling wheel assembly 46C, the reeling wheel axle 15B can be a single axle. An axial hole 42B is provided at one end of a stationary axle 4 proximate to the reeling wheel axle 15B, and movably fits with a circumferential surface 40B of the reeling wheel axle 15B. A circumferential surface 48B of the reeling wheel axle 15B is fit to a central through hole 38 of the left disk 17. There are four shaped keys 57 in a shape of ⊏ on the circumferential surface 48B of the reeling wheel axle 15B that can fit with the shaped grooves 56 of the first clutch half 20.

When the hose is pulled out, the lever 34 is in the start position and the clutch 47 is in the disengaged state. At this time the reeling wheel axle 15B remains stationary and the reeling wheel rotates counterclockwise about the reeling wheel axle 15B.

When the treadle 35 is being pressed down, the lever 34 drives the internal sector gear 30 to rotate counterclockwise. Under the action of the internal sector gear 30, the transmission gear 29 rotates counterclockwise. Since the driving gear 27 and the transmission gear 29 are fixed coaxially, the driving gear 27 rotates counterclockwise under the driving of the transmission gear 29. Acted by the driving gear 27, the driven gear 28 rotates clockwise. Since the driven gear 28 is fixed to the reeling wheel axle 15B, the reeling wheel axle 15B rotates clockwise under the action of the driven gear 28. The rotation of the reeling wheel axle 15B causes the first clutch half 20 to rotate clockwise. Since at this time the one-way cogs 55 of the first clutch half 20 are engaged with the recesses 58 of the control member 21 and the detent 22 damps down the rotation of the control member 21, the movement of the first clutch half 20 lags behind the movement of the semi reeling wheel axle 16. Under the camming actions between the slopes of the shaped keys 57 of the reeling wheel axle 15B and the slopes of the shaped grooves 56 of the first clutch half 20, the one-way cogs 55 of the first clutch half 20 slide out of the recesses 58 of the control member 21, and the first clutch half moves toward the second clutch half 18, resulting in the engagement of the teeth 51 of the first clutch half 20 with the teeth 52 of the second clutch half 18. Therefore, the first clutch half and the second clutch half are engaged with each other axially. Then the first clutch half 20 drives the second clutch half 18 to rotate clockwise, and in turn, drives the reeling wheel to rotate clockwise. Thus, the retraction of the hose is achieved. At this time, the tension spring 31 is in tension.

Once the clockwise rotation speed of the reeling wheel is higher than that of the reeling wheel axle 15B due to the action of the inertia during the retraction of the hose, there will be a relative rotation between the reeling wheel and the reeling wheel axle 15B. Since the first clutch half 20 rotates clockwise as the reeling wheel rotates, that means there is a relative rotation between the reeling wheel axle 15 B and first clutch half 20. When the shaped key 57 of the reeling wheel axle 15B slides along the slope of the shaped groove 56 to the opening 59 of the shaped groove 60 (i.e., a portion without slope) as the reeling wheel axle 15B rotates, the first clutch half 20 moves axially away from the second clutch half 18 under the action of the compression spring 19, and therefore the clutch is in the disengaged state. In this way, the reeling wheel is allowed to rotate in a speed higher than that of the reeling wheel axle 15B.

When the treadle 35 is released, the lever 34 drives the internal sector gear 30 to rotate clockwise under the action of the tension spring 31, and the transmission gear 29 rotates clockwise under the action of the internal sector gear. Since the driving gear 27 is coaxially fixed to the transmission gear 29, the driving gear 27 rotates clockwise under the driving of the transmission gear 29, and the driven gear 28 rotates counterclockwise under the action of the driving gear 27. Since the driven gear 28 is fixed to the reeling wheel axle 15B, under the action of the driven gear 28, the reeling wheel axle 15B rotates counterclockwise. During the counterclockwise rotation of the reeling wheel axle 15B, due to the axial bias of the compression spring 19 to the first clutch half 20 and the camming action of the recesses 58 of the control member 21 on the one-way cogs 55 of the first clutch half 20, the first clutch half 20 moves axially away from the second clutch half 18 until the one-way cogs 56 of the first clutch half 20 entirely fall into the recesses 58 of the control member 21, and therefore the clutch 47 is in the disengaged state.

Fifth Embodiment

Figure 28:
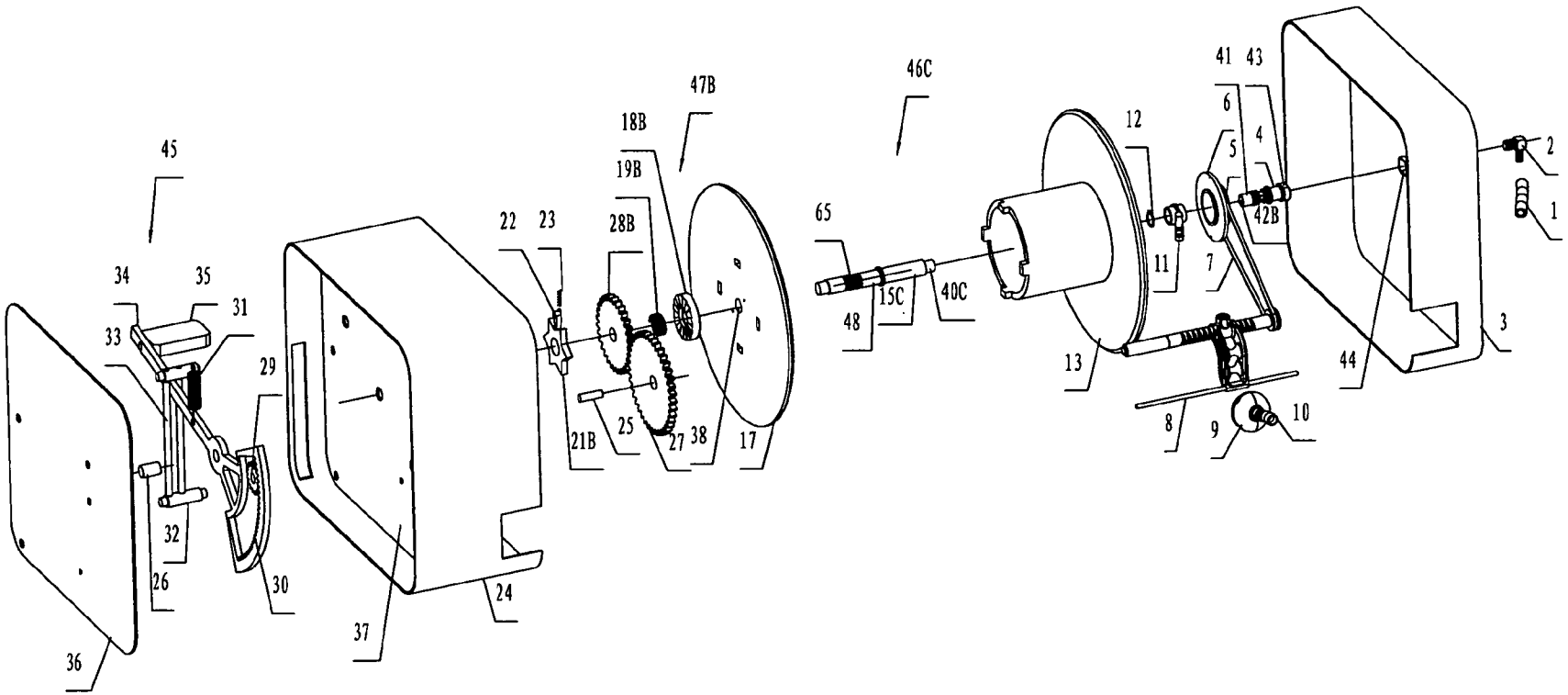
FIG. 28 is an exploded view of a treadle hose reeler according to a fifth embodiment of the invention.
Figure 29:
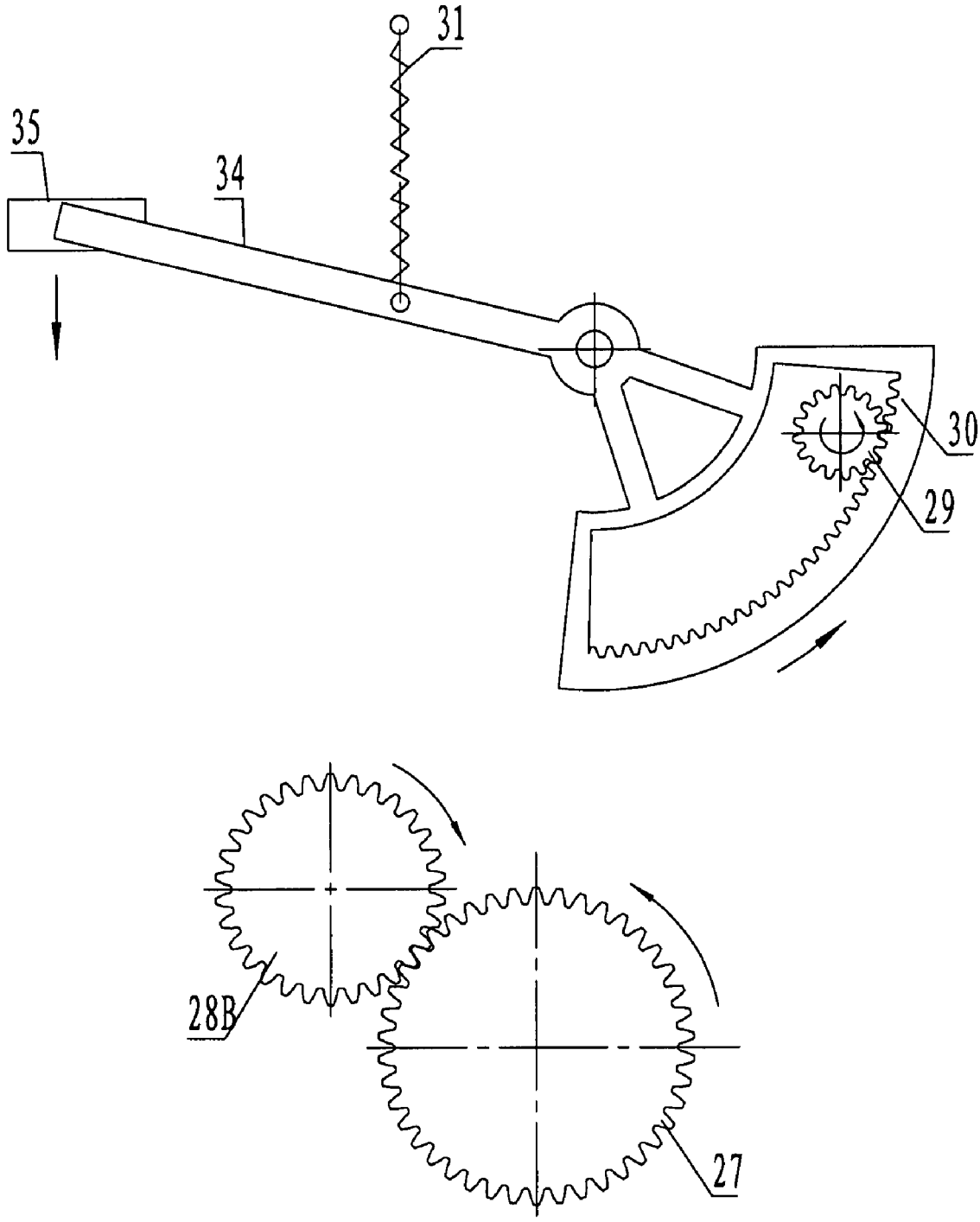
FIG. 29 is a schematic diagram which shows the movements of various parts of the reeling wheel drive when a treadle is trod down in the fifth embodiment.
Figure 30:
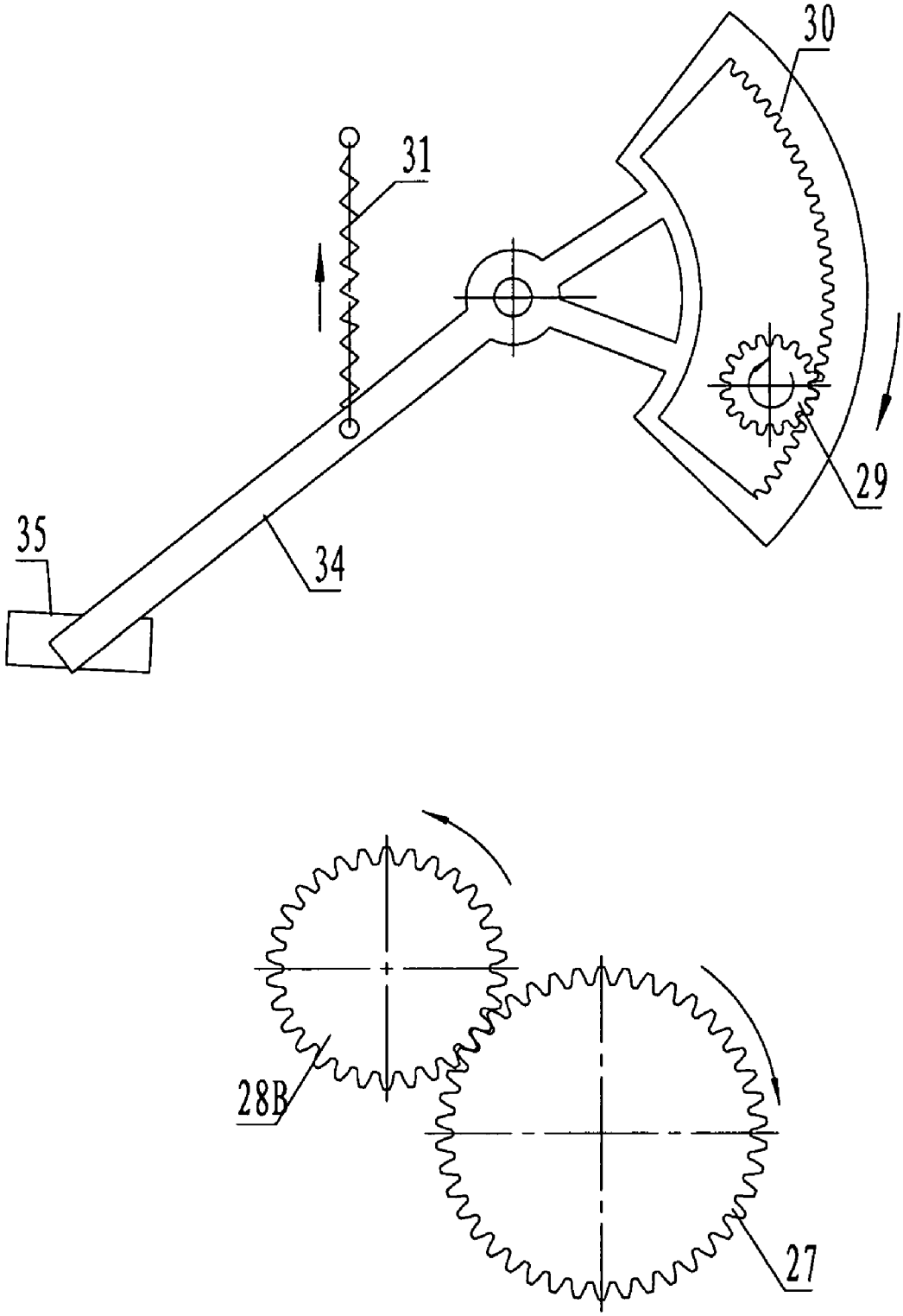
FIG. 30 is a schematic diagram showing the movements of the various parts of the reeling wheel drive when the treadle is released in the fifth embodiment.

See FIGS. 28-30 which show a hose reeler according to the fifth embodiment of the invention. This embodiment is substantially the same as the second embodiment of the invention with the difference only lying in that the coil spring in the second embodiment is not used and a single axle is employed here as a reeling wheel axle to replace the combination of the principal reeling wheel axle and the semi reeling wheel axle in the second embodiment. Therefore, only the portion different from the first embodiment will be described, and the remainder can refer to the second embodiment.

In this embodiment, since no coil spring is used in the reeling wheel assembly 46C, the reeling wheel axle 15C can be a single axle. There is an axial hole 42B at one end of a stationary axle 4 proximate to the reeling wheel axle 15C. The axial hole 42B can movably fit with a circumferential surface 40C of the reeling wheel axle 15C which in turn is fit to a central through hole 38 in the left disk 17 of the reeling wheel. There is a length of external thread 65 on a side of reeling wheel axle 15C proximate to the left disk 17.

When the hose is pulled out, the lever 34 is in the start position and the one-way teeth 63 on the driven gear 28B and the one-way teeth 61 on the transmission connector 18B are disengaged, and the clutch 47B is in the disengaged state. At this time, the reeling wheel axle 15C remains stationary, and the reeling wheel rotates counterclockwise about the reeling wheel axle 15C.

When the treadle 35 is being pressed down, the lever 34 drives the internal sector gear 30 to rotate counterclockwise, and the transmission gear 29 rotates counterclockwise under the driving of the internal sector gear 30. Since the driving gear 27 and the transmission gear 29 are fixed coaxially, the driving gear 27 rotates counterclockwise under the driving of the transmission gear 29. Acted by the driving gear 27, the driven gear 28B rotates clockwise. Since the driven gear 28B is fit with the reeling wheel axle 15C by means of threads, the clockwise rotation of the driven gear 28B causes the reeling wheel axle 15C to rotate clockwise therewith. However, due to the damping action of the detent 22 on the wave wheel 21B, the rotation of the reeling wheel axle 15C lags behind the rotation of the driven gear 28B. In this case, the driven gear 28B moves toward the transmission connector 18B via screwing action, until the one-way teeth 63 on the driven gear 28B mesh with the one-way teeth 61 on the transmission connector 18B, and the transmission connector 18B rotates clockwise under the action of driven gear 28B thereby to drive the reeling wheel, which is fixed to the transmission connector, to rotate clockwise. Therefore the hose is retracted. At this time, the tension spring 31 is in tension.

During the retraction of the hose, once the clockwise rotation speed of the reeling wheel is higher than that of the reeling wheel axle 15C due to the action of inertia (i.e., there is a relative rotation between the transmission connector 18B and the driven gear 28B, and the movement of the driven gear 28B lags behind that of the transmission connector 18B), the reeling wheel axle 15C remains stationary relative to the driven gear 28B due to the damping action of the detent 22 on the wave wheel 21B. The one-way teeth 63 of the driven gear 28B escape from the one-way teeth 61 of the transmission connector 18B under the action of the one-way teeth 61 of the transmission connector 18B and the compression spring 19B, and the transmission gear 28B moves away from the transmission connector 18B until the one-way teeth 63 of the driven gear 28B is disengaged from the one-way teeth 61 of the transmission connector 18B. In this way, the reeling wheel is allowed to rotate in a speed higher than that of the reeling wheel axle 15C.

When the treadle 35 is released, the lever 34 drives the internal sector gear 30 to rotate clockwise under the action of the tension spring 31, and the transmission gear 29 rotates clockwise under the action of the internal sector gear 30. Since the driving gear 27 is coaxially fixed to the transmission gear 29, the driving gear 27 rotates clockwise under the driving of the transmission gear 29, and the driven gear 28B rotates counterclockwise under the action of the driving gear 27. Due to the damping action of the detent 22 on the wave wheel 21B, the reeling wheel axle 15C remains stationary relative to the driven gear 28B. Then the one-way teeth 63 of the driven gear 28B escape from the one-way teeth 61 of transmission connector 18B and the driven gear 28B move away from transmission connector 18B. Therefore, the driven gear 28B is in idle running about the axis of the reeling wheel axle 15C.

Figure 31:
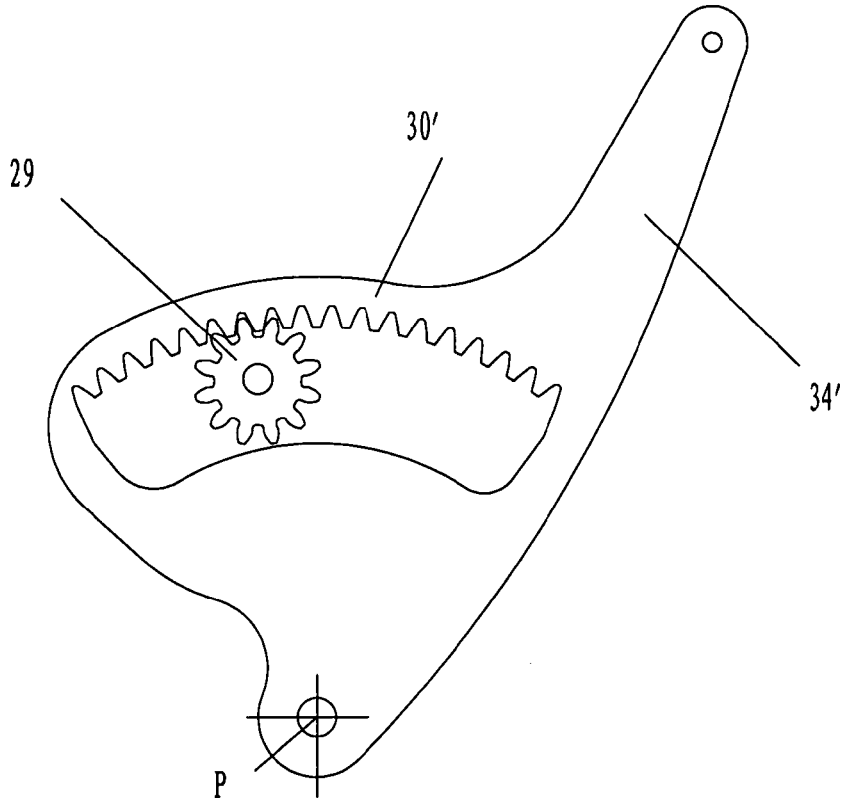
FIG. 31 shows a modification of main parts (an internal sector gear and a lever) in the reeling wheel drive of the invention shown in FIG. 1.

FIG. 31 shows an optional modification of the internal sector gear and the lever of the reeling wheel drive shown in FIG. 1 in accordance with the present invention. In this modification, the internal sector gear 30' and the lever 34' are at the same side of the pivot P (corresponding to the axis of the secondary axle 26 in FIG. 1). Swinging about the pivot P, the lever 34' drives the internal sector gear 30' to swing, and therefore the transmission gear 29 which internally meshes with the internal sector gear 30' is driven. This modification is helpful in reducing the size of the lever-internal sector gear assembly.

Figure 8:
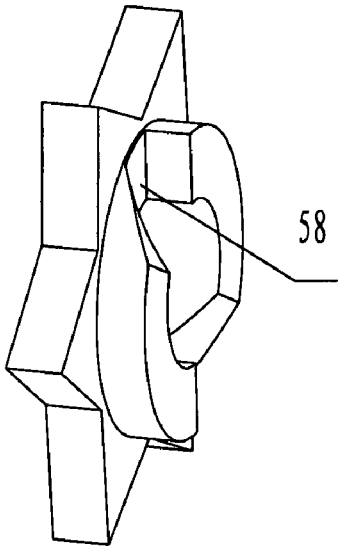
FIG. 8 is a perspective view of a control member of the overrunning clutch.
Figure 9:
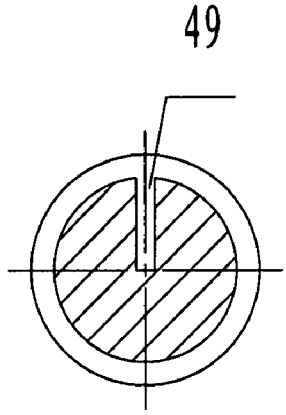
FIG. 9 is a sectional view of a principal reeling wheel axle.
Figure 10:
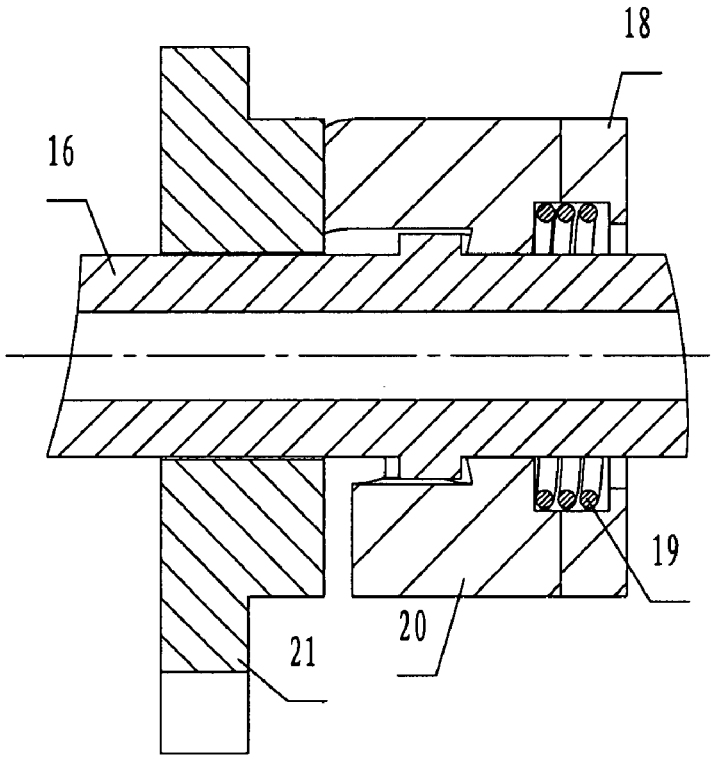
FIG. 10 is an assembly diagram of the overrunning clutch.
Figure 11:
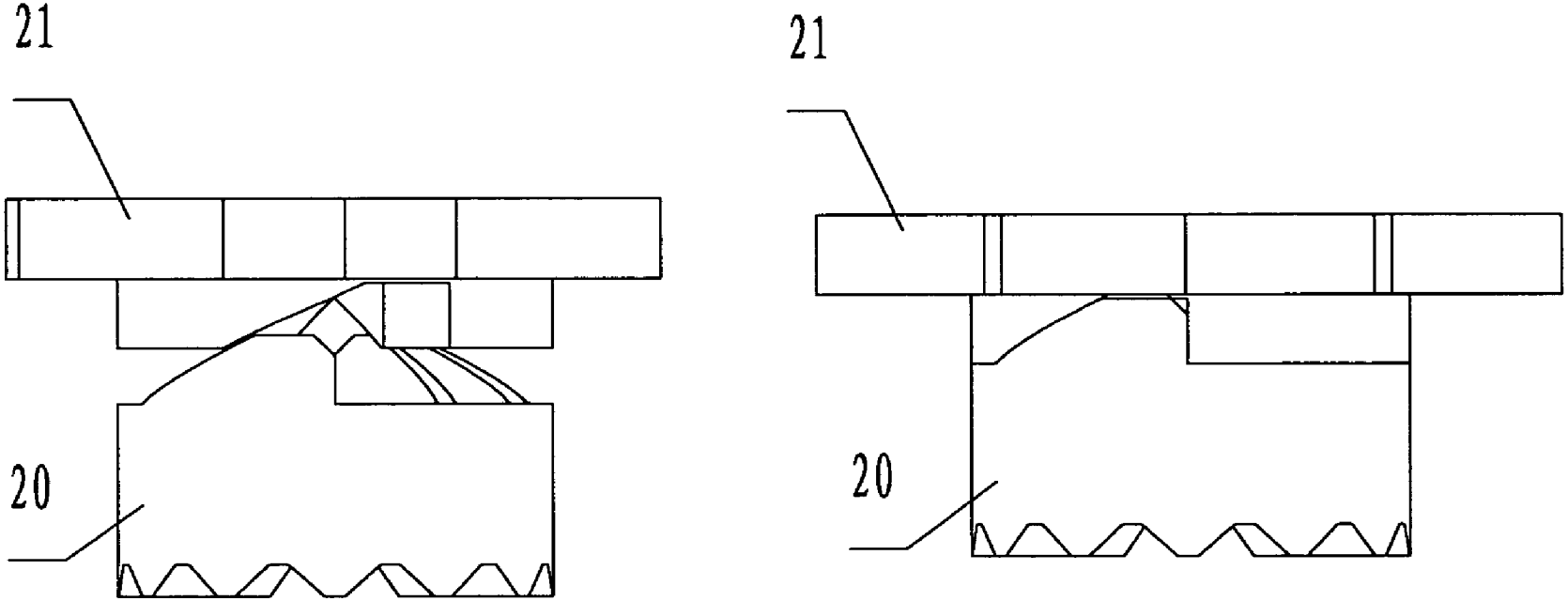
FIG. 11 is a schematic diagram showing the engagement between the first clutch half and the control member.
Figure 12:
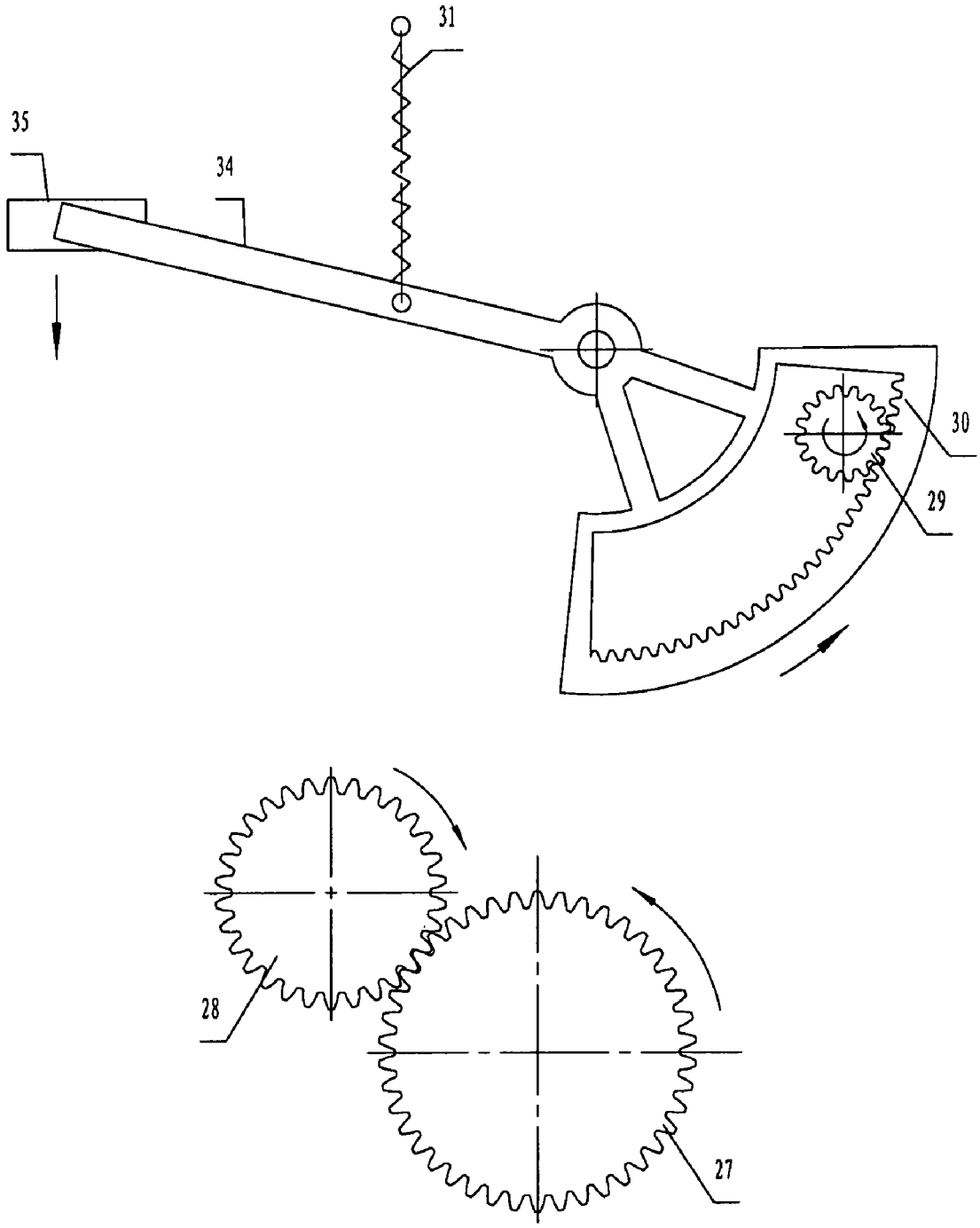
FIG. 12 is a schematic diagram showing the movement of various parts of a reeling wheel drive when a treadle is trod down.
Figure 13:
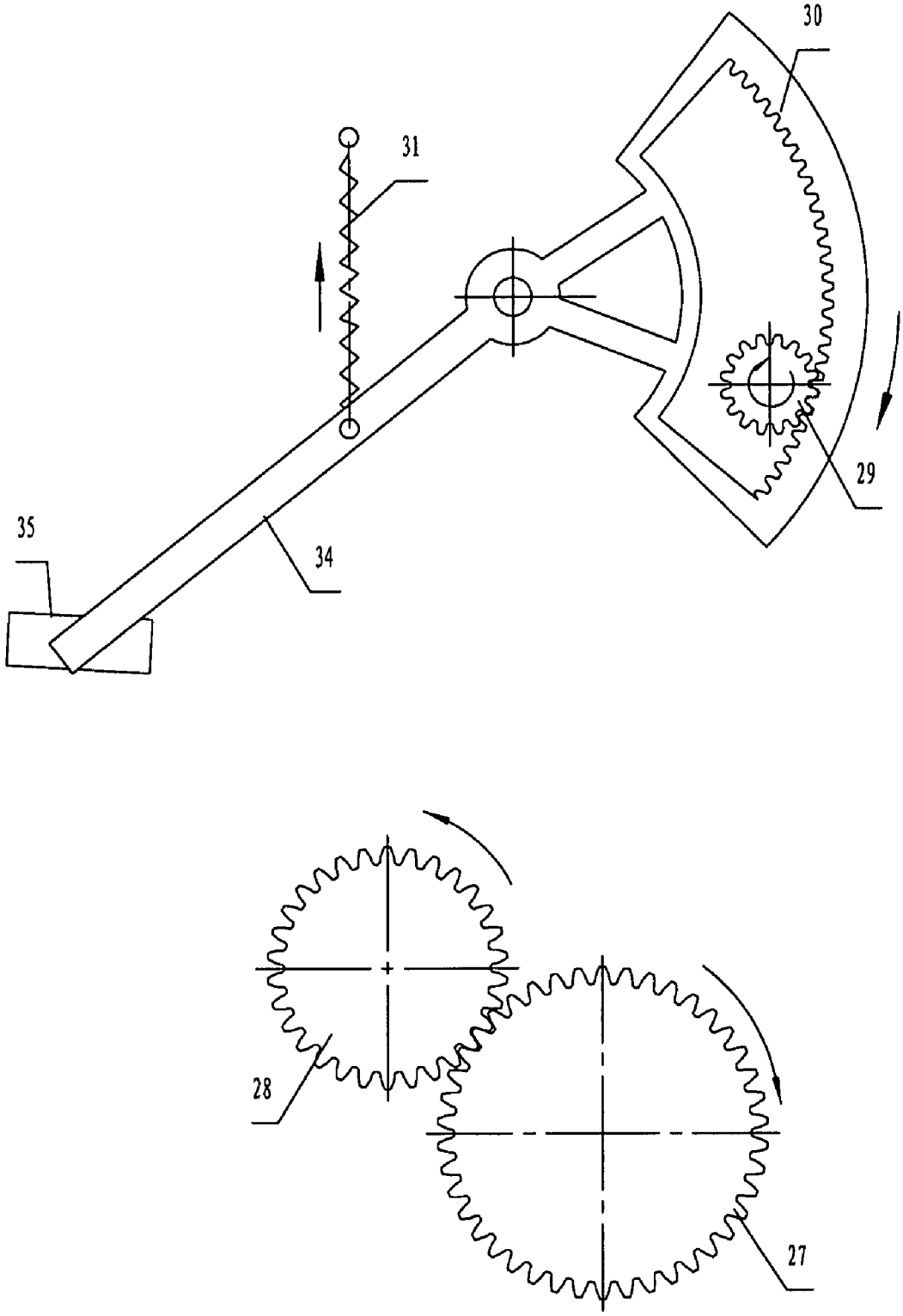
FIG. 13 is a schematic diagram showing the movement of the various parts of the reeling wheel drive when the treadle is released.
Figure 14:
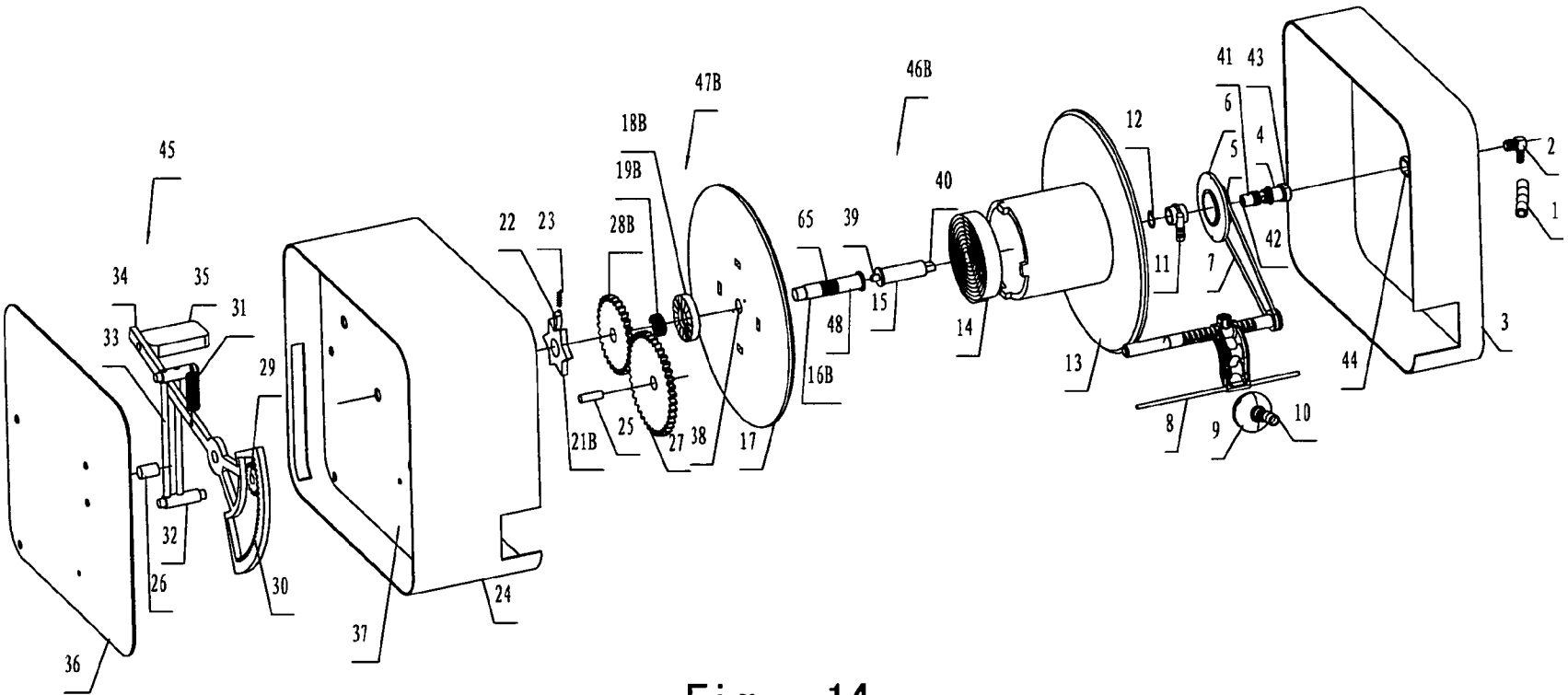
FIG. 14 is an exploded view of a treadle hose reeler according to a second embodiment of the invention.
Figure 16:
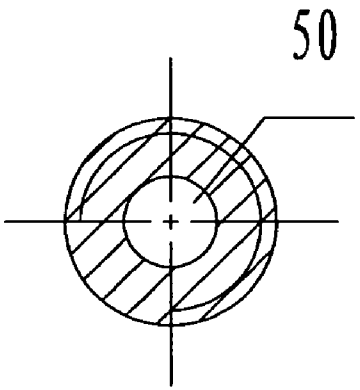
FIG. 16 is a sectional view along the B-B line in FIG. 15.
Figure 15:
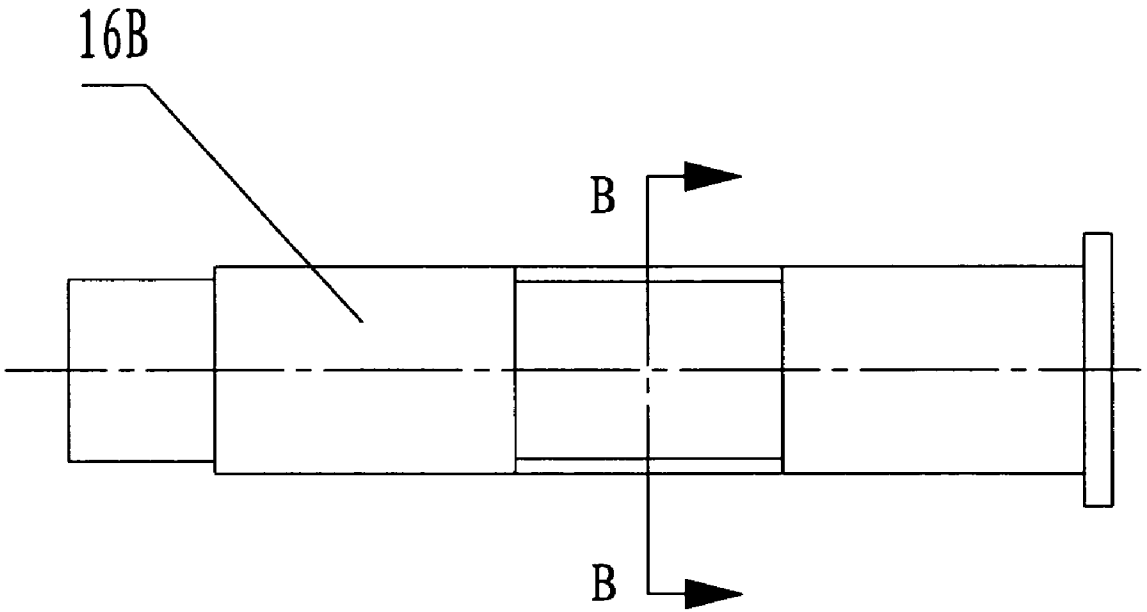
FIG. 15 is a front view of a semi reeling wheel axle used in the second embodiment.
Figure 19:
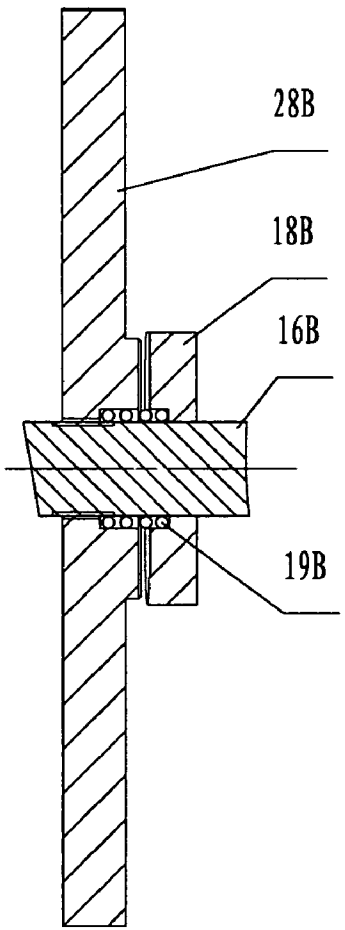
FIG. 19 is a schematic assembly diagram of a driven gear, a semi reeling wheel axle, a compression spring and a transmission member that constitute a clutch in the second embodiment.
Figure 18:
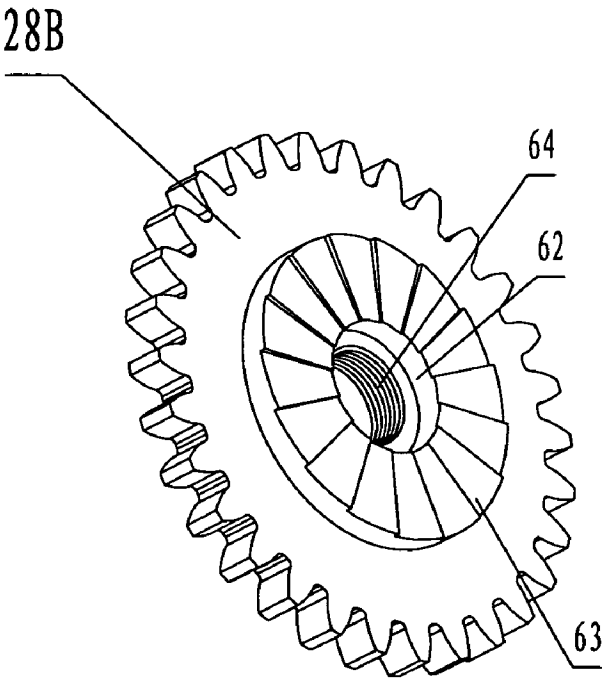
FIG. 18 is a perspective view of a driven gear used in the second embodiment.
Figure 17:
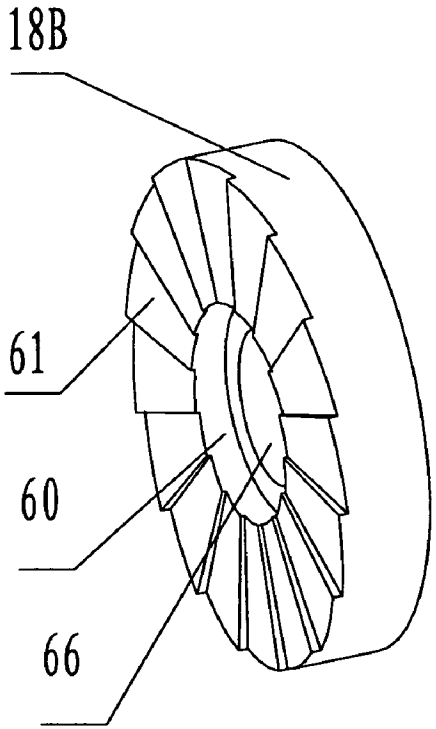
FIG. 17 is a perspective view of a transmission member used in the second embodiment.
Figure 20:
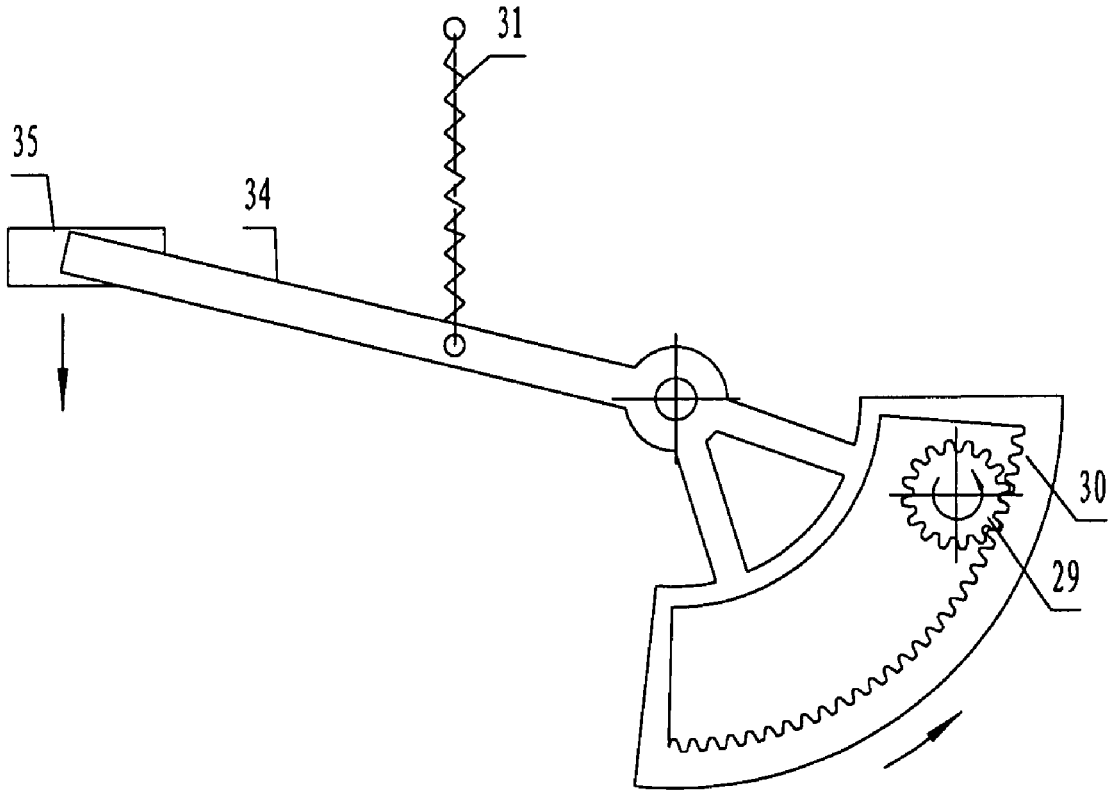
FIG. 20 is a schematic diagram showing the movements of various parts of a reeling wheel drive when a treadle is trod down in the second embodiment.
Figure 20:
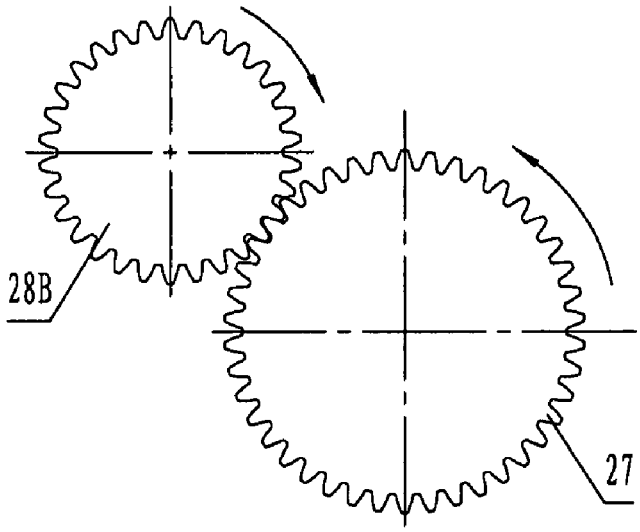
Figure 21:
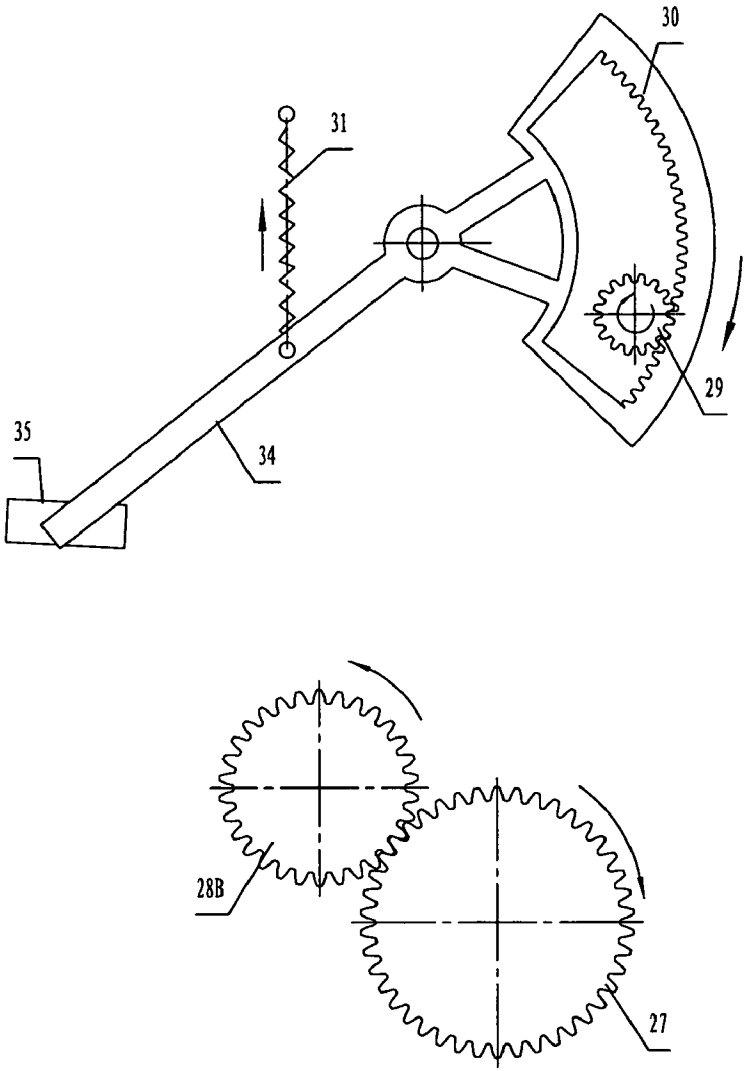
FIG. 21 is a schematic diagram showing the movements of the various parts of the reeling wheel drive when the treadle is released.
Figure 32:
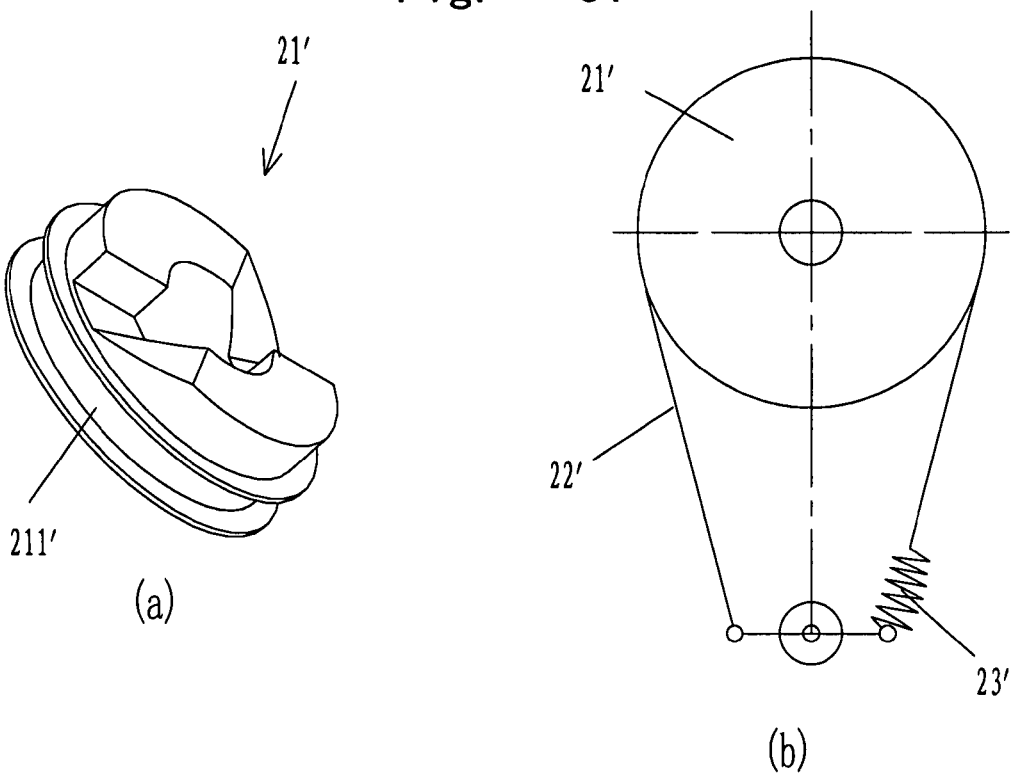
FIG. 32 shows a modification of the control member in the overrunning clutch of the invention shown in FIG. 8, wherein (a) is a perspective view and (b) is a schematic assembly diagram of the control member.

FIG. 32 shows a modification of the control mechanism of the overrunning clutch shown in FIG. 1 and FIG. 8 in accordance with the present invention. FIG. 32(*a*) is a perspective view of a control member of the mechanism and FIG. 32(*b*) is a schematic diagram which shows the assembly of the control member. In the modification, the control member is a belt pulley 21' having a belt winding portion 211' on its circumference and a belt 22' winding around the belt winding portion 211'. Opposite ends of the belt 22' are fixed to a stationary portion (for example, the left housing 24) with one end tensioned by a spring 23' at a predetermined tension force. That is to say, the control member 21, the detent 22 and the spring 23 constituting the control mechanism of the first embodiment of the invention are replaced by a control member in the form of a belt pulley 21', a belt 22' and a spring 23', with the semi reeling wheel axle 16 unchanged. Except the belt winding portion 211', the structures of the control member 21' are substantially the same as the control member 21 in the first embodiment. When the belt pulley 21' rotates in one direction (the counterclockwise direction in FIG. 32(*b*)), the spring 23' is tensioned, and therefore the damping force applied by belt 22' to the belt pulley 21' is increased and the rotation of the belt pulley is damped down. This shows that the function of the above pulley-belt arrangement is substantially the same as that of the wave wheel-detent arrangement in the first embodiment of the invention, i.e., both to damp down the rotation of the control member.

A detailed description has been given to the various embodiments of the invention in the above. It is understood that the invention is not limited to these exemplary embodiments. Those skilled in the art can make varieties of equivalent modifications and changes to the above embodiments within the present inventive concept. For example, although in the embodiments described herein the lever in the reeling wheel drive is a foot-treading type, a hand pulling or other appropriate types can be adopted. Although in the described embodiments an automatic overrunning clutch is used, a manually operated or other appropriate clutches can be used, e.g., a manually operated clutch (such a manual-type clutch is well known) comprising first and second clutch halves that can be engaged with or disengaged from each other axially and a manually operated mechanism that is connected with one of the first and second clutch halves and extends out of a housing of a hose/cable reeler for manipulation by an operator to control the engagement and disengagement between the halves. Although in the described embodiments the transmission member in the reeling wheel drive is a gear rack or an internal sector gear, an external gear or other appropriate forms can be employed. Although in the described embodiments the rotation damping mechanism comprises a wave wheel-detent or a pulley-belt arrangement, any other known appropriate structures which can damp down the rotation can be used. Therefore, the scope of the invention should not limited to the described embodiments and is intended to be defined by the appended claims.

What is claimed is:

1. A hose or cable reel, comprising: a housing; a reeling wheel assembly, mounted in the housing, and including a reeling wheel axle supported by the housing and a reeling wheel mounted on the reeling wheel axle with the reeling wheel axle serving as a center, the reeling wheel being adapted to wind a hose, cable or the like thereon, and to rotate in a first direction to wind the hose and in a second direction opposite to the first direction to unwind the hose; and a reeling wheel drive mounted in the housing and detachably coupled with the reeling wheel through a clutch to drive the reeling wheel to rotate in the first direction, the reeling wheel being coupled with the reeling wheel drive when the clutch is operated into an engaged state, and the reeling wheel being uncoupled from the reeling wheel drive when the clutch is operated into a disengaged state, wherein the reeling wheel drive comprises: a lever, swingably supported by the housing, and having a stationary portion that is pivoted to the housing and a free end that is opposite to the stationary portion, the lever being adapted to swing manually within a predetermined range between a start position and an end position with the stationary portion as a fulcrum, and the lever being connected with a spring and biased by the spring towards the start position; a driven gear mounted coaxially and fixedly with respect to the reeling wheel; a driving gear mounted to engage the driven gear; a transmission gear mounted coaxially with respect to the driving gear; and a transmission member engaged with the transmission gear to drive the transmission gear, the transmission member having mesh teeth on a side facing the transmission gear to mesh with the driving gear, and the transmission member being connected with the lever to reciprocate as the lever swings.

2. The hose or cable reel according to claim 1, wherein the clutch is an overrunning clutch, comprising a first clutch half and a second clutch half that are able to axially engage with and disengage from each other and a control mechanism that cooperates with the first clutch half to control the axial engagement and disengagement between the first clutch half and the second clutch half, the control mechanism including: a control member that is able to rotate on the reeling wheel axle and has a first cam portion; a first cam follower portion provided on the first clutch half and cooperated with the first cam portion of the control member; a second cam portion provided on the reeling wheel axle; a second cam follower portion provided on the first clutch half and cooperated with the second cam portion provided on the reeling wheel axle; a compression spring provided between the first clutch half and the second clutch half for biasing the halves in a direction of disengagement thereof; and a rotation damping means to damp down the rotation of the control member, wherein the control member is disposed to be axially stationary relative to the reeling wheel axle, the first clutch half is disposed relative to the reeling wheel axle so as to be movable axially within a determined lengthwise range and be rotatable within a determined angular range, the second clutch half is fixed to the reeling wheel, the first cam portion of the control member and the first cam follower portion of the first clutch half are configured such that when the first clutch half rotates, along with the second clutch half and the reeling wheel, in the second direction relative to the control member or when the reeling wheel rotates in the first direction relative to the reeling wheel axle, the first clutch half moves axially in a direction away from the second clutch half under the bias of the compression spring, whereby the clutch is operated into the disengaged state, and the second cam portion of the reeling wheel axle and the second cam follower portion of the first clutch half are configured such that when the reeling wheel axle rotates in the first direction relative to the first clutch half and the reeling wheel within the determined angular, the first clutch half moves axially towards the second clutch half against the bias of the compression spring, whereby the clutch is operated into the engaged state.

3. The hose or cable reel according to claim 2, wherein the first cam portion comprises at least one recess having a slope fixedly disposed on the control member and the first cam follower portion comprises at least one cog fixedly disposed on the first clutch half, the cog fitting in the recess and being able to slide along the slope of the recess.

4. The hose or cable reel according to claim 3, wherein the cog has a slope that is complementary to and mates with the slope of the recess.

5. The hose or cable reel according to claim 2, wherein the second cam portion comprises at least one key fixedly disposed on a circumferential surface of the reeling wheel axle and the second cam follower portion comprises at least one shaped groove having a slope fixedly disposed on the first clutch half, the key fitting in the shaped groove and being able to slide along the slope of the shaped groove.

6. The hose or cable reel according to claim 5, wherein the key has a slope that is complementary to and mates with the slope of the shaped groove.

7. The hose or cable reel according to claim 2, wherein both the first clutch half and the second clutch half are formed with teeth on opposing end surfaces thereof, the first clutch half and the second clutch half being engaged with each other by means of the teeth.

8. The hose or cable reel according to claim 2, wherein both the first clutch half and the second clutch half are formed with a counterbore on opposing end surfaces thereof, the compression spring being disposed between the first clutch half and the second clutch half with its opposite ends seated in the two counterbores respectively.

9. The hose or cable reel according to claim 2, wherein the control member is formed as a wave wheel with waved teeth on its circumference, the wave wheel being rotatably mounted on the reeling wheel axle, the waved teeth of the wave wheel being engaged with a detent that is mounted to the housing by means of a spring, and the detent engaging the waved teeth of the wave wheel under the bias of the spring, whereby the waved teeth, the detent and the spring constitute the rotation damping means for damping down the rotation of the wave wheel on the reeling wheel axle.

10. The hose or cable reel according to claim 2, wherein the control member is formed as a belt pulley with a belt winding portion on its circumference, the belt pulley being rotatably mounted on the reeling wheel axle, and a belt being wound on the belt winding portion of the belt pulley with opposite ends of the belt fixed to a stationary portion of the housing under a determined tension, whereby the belt and the belt winding portion constitute the rotation damping means for damping down the rotation of the belt pulley on the reeling wheel axle.

11. The hose or cable reel according to claim 10, wherein the rotation damping means further comprises a tension spring connected between one end of the belt and the stationary portion of the housing.

12. The hose or cable reel according to claim 1, wherein the clutch comprises a first clutch half and a second clutch half that are able to axially engage with and disengage from each other and a control mechanism that cooperates with the first clutch half to control the axial engagement and disengagement between the first clutch half and the second clutch half, both the first clutch half and second clutch half being formed with one-way teeth that are able to engage with each other in a one-way manner, the first clutch half being fixed to the driven gear, and the second clutch half being fixed to the reeling wheel, wherein the control mechanism comprises: an external thread formed on a portion of a circumferential surface of the reeling wheel axle; an internal thread formed in a central bore of the first clutch half and engaging the external thread, the first clutch half being movable axially relative to the reeling wheel axle within a predetermined range by means of a screwing action between the internal thread and the external thread; a compression spring disposed between the first clutch half and second clutch half for biasing the first clutch half and second clutch half in a direction to separate them from each other; and a rotation damping means adapted to damp down the rotation of the reeling wheel axle, wherein the internal thread and the external are configured such that when rotating in the first direction the first clutch half moves axially towards the second clutch half against the bias of the compression spring until it is engaged with the second clutch half.

13. The hose or cable reel according to claim 12, wherein the rotation damping means comprises a wave wheel that is fixed to the reeling wheel axle and has waved teeth on its circumference, and a detent that is mounted to the housing through a spring and engages the waved teeth of the wave wheel, the detent engaging the waved teeth of the wave wheel under the bias of the spring to damp down the rotation of the wave wheel.

14. The hose or cable reel according to claim 12, wherein the rotation damping means comprises a belt pulley that is fixed to the reeling wheel axle and has a belt winding portion on its circumference, and a belt that is wound on the belt winding portion of the belt pulley, with opposite ends of the belt being fixed to a stationary portion of the housing under a determined tension, for damping down the rotation of the belt pulley.

15. The hose or cable reel according to claim 14, wherein the rotation damping means further comprises a tension spring that is connected between one end of the belt and the stationary portion of the housing.

16. The hose or cable reel according to claim 12, wherein both the first clutch half and the second clutch half are formed with a counterbore on opposing end surfaces thereof, the compression spring being disposed between the first clutch half and the second clutch half with its opposite ends seated in the two counterbores respectively.

17. The hose or cable reel according to claim 12, wherein the mating internal thread and external thread are multi start thread.

18. The hose or cable reel according to claim 1, wherein the reeling wheel axle comprises a principal reeling wheel axle that is fixed to the housing and a semi reeling wheel axle that is coaxial with the principal reeling wheel axle and is rotatably supported by the housing, and the reeling wheel assembly further comprises a coil spring mounted between the principal reeling wheel axle and the reeling wheel, with one end of the coil spring fixed to the principal reeling wheel axle and other end fixed to the reeling wheel.

19. The hose or cable reel according to claim 1, wherein the clutch is a manually operated clutch.

20. The hose or cable reel according to claim 19, wherein the manually operated clutch comprises a first clutch half and a second clutch half that are able to be axially engaged with and disengaged from each other, and a manually operated mechanism that is connected with at least one of the two clutch halves to control the axial engagement and disengagement between the first clutch half and the second clutch half.

21. The hose or cable reel according to claim 1, wherein a treadle is mounted on the free end of the lever for treading.

22. The hose or cable reel according to claim 1, wherein the transmission member in the reeling wheel drive is a sector gear that is fixed to the lever and swings reciprocally about the stationary portion along with the lever.

23. The hose or cable reel according to claim 22, wherein the sector gear is an internal gear.

24. The hose or cable reel according to claim 1, wherein the transmission member in the reeling wheel drive is a gear rack, one end of which is connected to the lever so as to reciprocate linearly as the lever swings.

* * * * *